US010549936B2

(12) United States Patent
Shimura et al.

(10) Patent No.: US 10,549,936 B2
(45) Date of Patent: Feb. 4, 2020

(54) STACKING APPARATUS

(71) Applicant: CANON FINETECH NISCA INC., Misato-shi (JP)

(72) Inventors: Takuya Shimura, Kofu (JP); Shoji Ito, Soka (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 16/010,787

(22) Filed: Jun. 18, 2018

(65) Prior Publication Data

US 2019/0002218 A1 Jan. 3, 2019

(30) Foreign Application Priority Data

Jun. 29, 2017 (JP) ..... 2017-127813
May 24, 2018 (JP) ..... 2018-099770

(51) Int. Cl.

*B65H 1/28* (2006.01)
*B65H 1/04* (2006.01)
*B65H 1/14* (2006.01)
*B65H 7/06* (2006.01)

(52) U.S. Cl.

CPC ..... *B65H 1/28* (2013.01); *B65H 1/04* (2013.01); *B65H 1/14* (2013.01); *B65H 7/06* (2013.01)

(58) Field of Classification Search

CPC ..... B65H 1/28; B65H 1/14; B65H 2405/331; B65H 2405/3311; B65H 2405/15; B65H 2701/11312
USPC ..... 271/9.12
See application file for complete search history.

(56) References Cited

U.S. PATENT DOCUMENTS 4,801,135 A * 1/1989 Povio ..... B65H 1/18 271/155
5,971,387 A * 10/1999 Kita ..... B65H 1/26 271/147
6,123,329 A * 9/2000 Sato ..... B65H 1/14 271/145
8,480,073 B1 * 7/2013 Ishikawa ..... B65H 1/14 271/126
9,592,973 B2 3/2017 Kushida et al.
9,815,643 B2 * 11/2017 Tanisaki ..... G03G 15/6508
(Continued)

FOREIGN PATENT DOCUMENTS

JP 2003-063719 A 3/2003
JP 2011-042495 A 3/2011
JP 2015-199556 A 11/2015

OTHER PUBLICATIONS

Extended European Search Report dated Dec. 3, 2018, in European Patent Application No. 18176946.4.

*Primary Examiner* — Michael C McCullough
(74) *Attorney, Agent, or Firm* — Venable LLP

(57) ABSTRACT

A first detection unit detects that a first stacking unit is positioned in a predetermined position and a second detection unit detects that a second stacking unit is positioned in a predetermined position. An upper surface detection unit detects one of a sheet stacked on the first stacking unit and an upper surface of the first stacking unit. It is determined that an error has occurred, when the sheet of the second size is set to be stacked, when the upper surface detection unit has detected a sheet stacked on the first stacking unit, and when the first stacking unit is not in the predetermined position and the second stacking unit is in the predetermined position.

24 Claims, 15 Drawing Sheets

(56) References Cited

U.S. PATENT DOCUMENTS

| | | | | |
|---|---|---|---|---|
| 2009/0001649 | A1 | 1/2009 | Ishikawa et al. | |
| 2013/0334771 | A1 | 12/2013 | Igarashi | |
| 2015/0130124 | A1* | 5/2015 | Muto | B65H 7/04 271/9.03 |
| 2016/0121633 | A1* | 5/2016 | Tanisaki | G03G 15/6508 271/9.01 |
| 2017/0160688 | A1 | 6/2017 | Kurohata et al. | |
| 2018/0267453 | A1* | 9/2018 | Yazawa | G03G 15/6502 |
| 2018/0354738 | A1* | 12/2018 | Yazawa | B65H 1/04 |
| 2019/0002218 | A1* | 1/2019 | Shimura | B65H 1/08 |

* cited by examiner

STACKING APPARATUS

BACKGROUND OF THE INVENTION

Field of the Invention

The present invention relates to a stacking apparatus.

Description of the Related Art

Some image forming apparatuses such as a copying machine and printer have an arrangement which includes a sheet storage unit and a feeding unit such as a feeding roller for feeding sheets stored in the sheet storage unit, and feeds a sheet stored in the sheet storage unit to an image forming unit by the feeding unit. Recently, apparatuses including a large-capacity sheet storage unit to which a large number of sheets such as thousands of sheets can be replenished are increasing in number. Also, in the recent printing market, needs for performing printing on elongated paper sheets longer than regular-size paper sheets such as A3 and A4 are increasing. Elongated paper sheets are used for a book cover, facing pages of a catalogue, POP advertisement, and the like.

In the conventional feeding apparatus corresponding to elongated paper sheets, a plurality of paper stacking lifters are arranged, and are independently operated in common use by using removable partition plates. Elongated paper sheets can be stacked and fed when the partition plates are removed and the stacking trays operate in synchronism with each other (Japanese Patent Laid-Open No. 2003-63719).

Also, some conventional feeding apparatuses corresponding to elongated paper sheets include a power source capable of operating even when elongated paper sheets exceeding the size of a regular paper stacking lifter are fully stacked, in order to make both plain paper sheets and elongated paper sheets usable. However, electric power is consumed more than necessary because the same power source is used even when using regular-size paper sheets. Therefore, there is a feeding apparatus which physically changes the number of stackable sheets for plain paper and elongated paper, such that the number of stackable sheets is 3,000 for plain paper, and 1,000 for elongated paper.

For example, in an arrangement including a main lifter for stacking plain paper sheets and an extension lifter for stacking elongated paper sheets, the main lifter can move upward/move downward within the range corresponding to the stacking position of, for example, 3,000 sheets. On the other hand, the extension lifter can move upward/move downward within the range corresponding to the stacking position of, for example, 1,000 sheets. In this arrangement, the main lifter and extension lifter synchronously move upward/move downward when the number of stacking sheets is 1,000 or less. When more than 1,000 sheets are stacked, however, the extension lifter waits in the position of 1,000 sheets, and the main lifter alone moves upward/moves downward.

In the abovementioned arrangement, when switching the operation to an elongated paper sheet with more than 1,000 plain paper sheets being stacked, there is a step between the main lifter and extension lifter. Accordingly, this step must be eliminated because no elongated paper sheet can be stacked. To eliminate the step, the main lifter must be moved upward. Generally, however, the lifter moves upward after the storage is closed in order to prevent injury of the user. Therefore, when the user removes the stacked plain paper sheets and closes the storage in order to eliminate the step between the lifters, it is necessary to perform an operation of checking whether the plain paper sheets are removed and eliminating the step by synchronizing the main lifter and extension lifter.

As an arrangement for determining whether a plain paper sheet remains on the lifter, Japanese Patent Laid-Open No. 2015-199556 describes an arrangement which detects whether a sheet is stacked in the feeding position when the stacking unit is in a position equal to or higher than a predetermined height during paper feeding.

Unfortunately, in the arrangement which detects whether a remaining sheet is stacked in the feeding position as described in Japanese Patent Laid-Open No. 2015-199556, the non-removal of the remaining sheet is sensed when the lifter has moved upward to the position of a sheet presence/absence sensor in the feeding position. That is, it is not until then that the user is urged to open the storage again and remove the paper sheet. As a consequence, the user's waiting time prolongs. Also, in the arrangement including the main lifter and extension lifter, if elongated paper sheets are stacked when there is a step between the main lifter and extension lifter after remaining sheets are removed, a stacking error occurs, and this troubles the user to perform error cancellation and the like, thereby degrading the usability.

SUMMARY OF THE INVENTION

The present invention provides a stacking apparatus which improves the usability when changing sheets.

The present invention in one aspect provides a stacking apparatus comprising: a first stacking unit configured to vertically move between an upper-limit position of upward movement and a lower-limit position of downward movement, and stack a sheet having a first size; a second stacking unit configured to be coupled with the first stacking unit in a predetermined position in a vertical movement direction of the first stacking unit, vertically move together with the first stacking unit while being coupled with the first stacking unit and stack a sheet having a second size larger than the first size by cooperating with the first stacking unit when the position of the first stacking unit is not lower than the predetermined position and not higher than the upper-limit position, and be decoupled from the first stacking unit when the position of the first stacking unit is lower than the predetermined position and not lower than the lower-limit position; a first detection unit configured to detect that the first stacking unit is positioned in the predetermined position; a second detection unit configured to detect that the second stacking unit is positioned in the predetermined position; an upper surface detection unit configured to detect one of a sheet stacked on the first stacking unit and an upper surface of the first stacking unit; a setting unit configured to set a size of a sheet to be stacked from sheets having a plurality of sizes including a sheet of the first size and a sheet of the second size; and a determination unit configured to determine that an error has occurred, when the sheet of the second size is set to be stacked by the setting unit, when the upper surface detection unit has detected a sheet stacked on the first stacking unit, and when the first stacking unit is not in the predetermined position and the second stacking unit is in the predetermined position.

The present invention can improve the usability when changing sheets.

Further features of the present invention will become apparent from the following description of exemplary embodiments with reference to the attached drawings.

DESCRIPTION OF THE EMBODIMENTS

Figure 1:
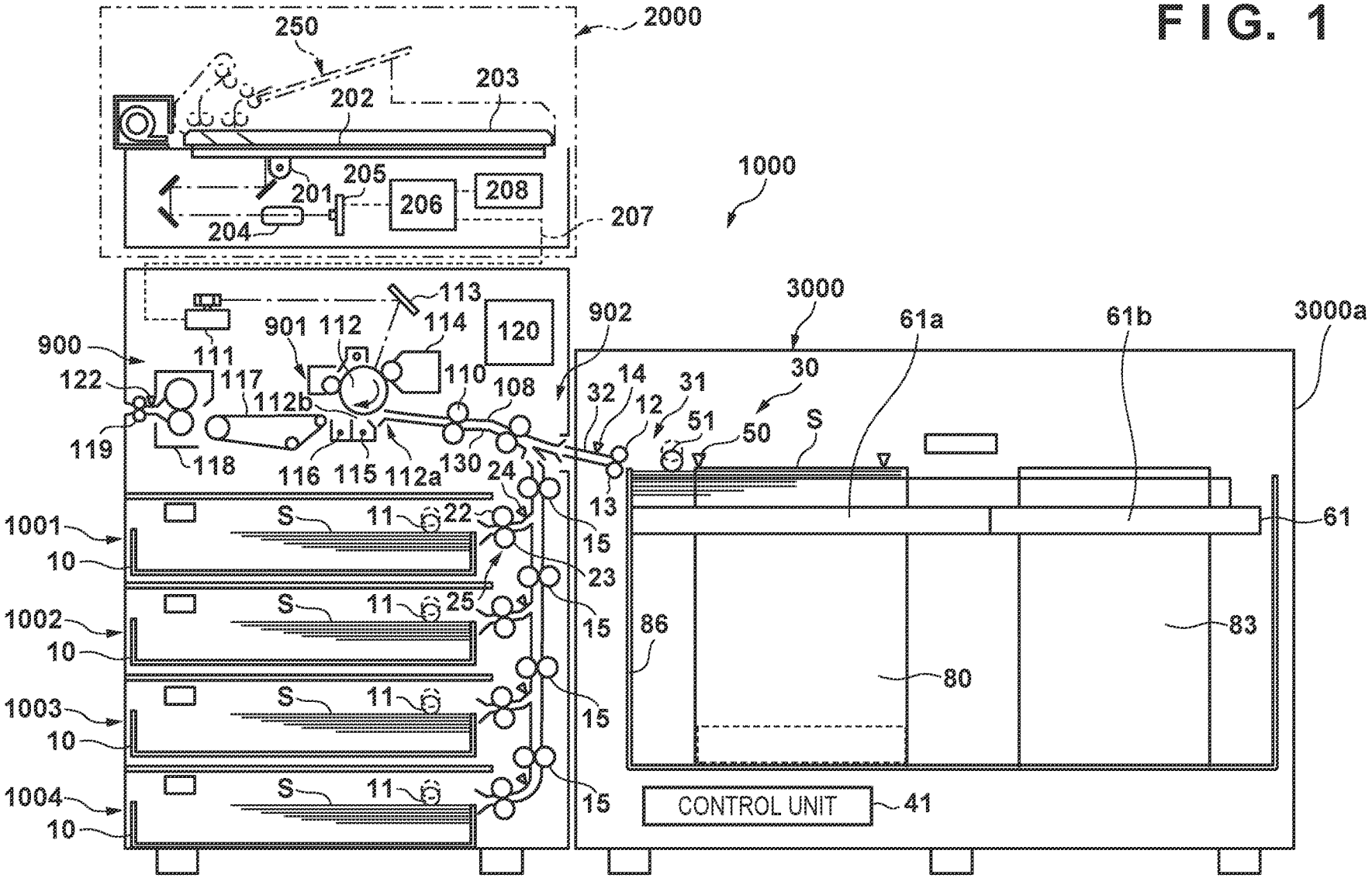
FIG. 1 is a schematic sectional view showing an image forming apparatus including a feeding apparatus.

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. Note that the same reference numerals denote the same constituent elements, and an explanation thereof will be omitted.

First Embodiment

FIG. 1 is a schematic sectional view showing an image forming apparatus (image forming system) including a feeding apparatus according to this embodiment. An image forming apparatus 1000 includes an image forming apparatus main body (to be referred to as an apparatus main body hereinafter) 900, a scanner apparatus 2000 arranged on the upper surface of the apparatus main body 900, and a paper deck 3000 connected to the apparatus main body 900.

The scanner apparatus 2000 includes a scanning optical system light source 201, a platen glass 202, an openable/closable document press plate 203, a lens 204, a light-receiving element (photoelectric conversion element) 205, an image processor 206, and a memory unit 208, and optically reads a document. The memory unit 208 stores an image processing signal processed by the image processor 206. The scanner apparatus 2000 reads a document (not shown) placed on the platen glass 202 by irradiating the document with light from the scanning optical system light source 201. The read document image is processed by the image processor 206, converted into an electrical signal 207 which is electrically encoded, and transmitted to a laser scanner 111 in the apparatus main body 900.

Note that it is also possible to temporarily store the image information processed by the image processor 206 and encoded in the memory unit 208, and transmit the stored information to the laser scanner 111 as needed in accordance with a signal from a controller 120 (to be described later). Note also that the paper deck 3000 includes a control unit 41 which controls the paper deck 3000 in accordance with a command from the controller 120. The control unit 41 includes a CPU, RAM, and ROM, and comprehensively controls the paper deck 3000.

The apparatus main body 900 includes feeding cassettes 1001, 1002, 1003, and 1004 for feeding sheets S, and a sheet conveying apparatus 902 for conveying the sheets S fed from the feeding cassettes 1001 to 1004 to an image forming unit 901. The apparatus main body 900 includes the controller 120 which comprehensively controls the individual units of the image forming apparatus 1000, and includes a CPU, RAM, and ROM. The cooperation of the controller 120 and control unit 41 implements the overall operation of the image forming apparatus 1000.

Each of the feeding cassettes 1001 to 1004 includes a storage unit 10 for storing the sheets S, a pickup roller 11, and a separation conveyor roller pair 25 including a feed roller 22 and a retard roller 23. The sheets S stored in the storage unit 10 are separately fed one by one by the pickup roller 11 which performs a vertical moving operation and rotates at a predetermined timing, and the separation conveyor roller pair 25. In addition, a feed sensor 24 is arranged near the downstream side of the feed roller 22 and retard roller 23 in the sheet feeding direction. The feed sensor 24 senses the passing of the sheet S, and transmits a sensing signal to the controller 120.

The sheet conveying apparatus 902 includes a conveyor roller pair 15, a pre-registration roller pair 130, and a registration roller pair 110. The sheet S fed from the feeding cassettes 1001 to 1004 is passed through a sheet conveyance path 108 by the conveyor roller pair 15 and pre-registration roller pair 130, and guided to the registration roller pair 110. After that, the registration roller pair 110 supplies the sheet S to the image forming unit 901 at a predetermined timing.

The image forming unit 901 includes a photosensitive drum 112, the laser scanner 111, a developing device 114, a transfer charging device 115, and a separation charging device 116. In image formation, a mirror 113 reflects a laser beam from the laser scanner 111, and the photosensitive drum 112 rotating clockwise is irradiated with the laser beam, thereby forming an electrostatic latent image on the photosensitive drum 112. Then, the electrostatic latent image formed on the photosensitive drum 112 is developed as a toner image by the developing device 114.

This toner image on the photosensitive drum 112 is transferred onto the sheet S by the transfer charging device 115 in a transfer unit 112*b*. A sensor 112*a* senses a sheet before the transfer charging device 115. Furthermore, the sheet S onto which the toner image is thus transferred is electrostatically separated from the photosensitive drum 112 by the separation charging device 116, conveyed by a conveyor belt 117 to a fixing apparatus 118 where the toner image is fixed, and discharged by discharge rollers 119. Note that the image forming unit 901 and fixing apparatus 118 form an image on the sheet S fed from a sheet feeding apparatus (feeding apparatus) 30 or the feeding cassettes 1001 to 1004.

In addition, a discharge sensor 122 is arranged in a conveyance path between the fixing apparatus 118 and discharger rollers 119. The controller 120 detects the passing of the discharged sheet S based on a sensing signal from the discharge sensor 122.

Note that the apparatus main body 900 and scanner apparatus 2000 are formed as discrete units in this embodiment, but the apparatus main body 900 and scanner apparatus 2000 may also be integrated. Note also that regardless of whether the apparatus main body 900 and scanner apparatus 2000 are separated or integrated, the apparatus functions as a copying machine when a processing signal of the scanner apparatus 2000 is input to the laser scanner 111, and functions as a FAX apparatus when a FAX transmission signal is input to the laser scanner 111. Furthermore, the apparatus functions as a printer when a signal from a personal computer (PC) is input to the laser scanner 111. Also, when a processing signal of the image processing unit 206 of the scanner apparatus 2000 is transmitted to another FAX apparatus, the apparatus functions as a FAX apparatus. In addition, an automatic document feeder (ADF) 250 as indicated by the alternate long and two short dashed lines is used instead of the press plate 203 in the scanner apparatus 2000, a plurality of documents (not shown) can be read in succession.

Figure 2A:
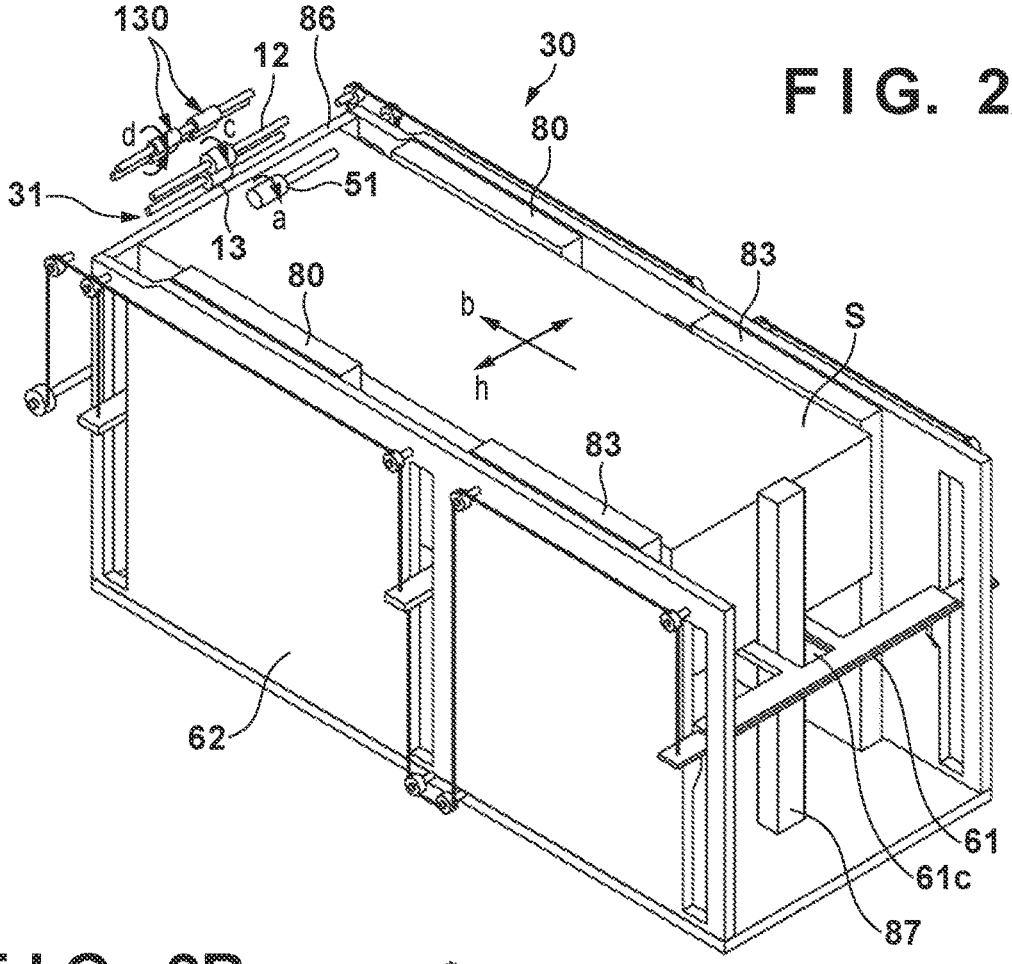
FIGS. 2A and 2B are perspective views showing the structure of a paper deck.

Next, the sheet feeding apparatus 30 of the image forming apparatus 1000 according to this embodiment will be explained by taking the paper deck 3000 as a large-capacity deck as an example. FIG. 2A is a perspective view showing the arrangement of main parts of the paper deck 3000 with an exterior cover being removed.

As shown in FIGS. 1 and 2A, the paper deck 3000 includes an apparatus main body 3000*a*, a large-capacity deck storage 62 accommodated in the apparatus main body 3000*a*, and the sheet feeding apparatus 30. The sheet feeding apparatus 30 feeds the sheets S stacked and accommodated in the large-capacity deck storage 62 to the image forming unit 901.

The sheet feeding apparatus 30 includes a pickup roller 51 for feeding the sheets S stacked in a main lifter (main tray) 61*a* and an extension lifter (extension tray) 61*b* (to be generally referred to as a lifter 61 hereinafter), and a separation conveyor roller pair 31. The separation conveyor roller pair 31 includes a feed roller 12 and a retard roller 13. Sheets SS of regular-size paper (to be referred to as, for example, plain paper hereinafter) are stacked on the main lifter 61*a*. The extension lifter 61*b* is used to extend a stacking region on the main tray and feed sheets SL of large-size paper (to be referred to as, for example, elongated paper hereinafter). The pickup roller 51 is arranged near the distal end portion in the sheet feeding direction (the direction of an arrow b in FIG. 2A) so that the pickup roller 51 can be urged against the uppermost sheet on the lifter 61 by applying an appropriate force to the sheet. Note that the pickup roller 51 is positioned above the lifter 61 and abuts against the uppermost one of the sheets S stacked on the lifter 61 having moved upward, thereby feeding the uppermost sheet.

Figure 7B:
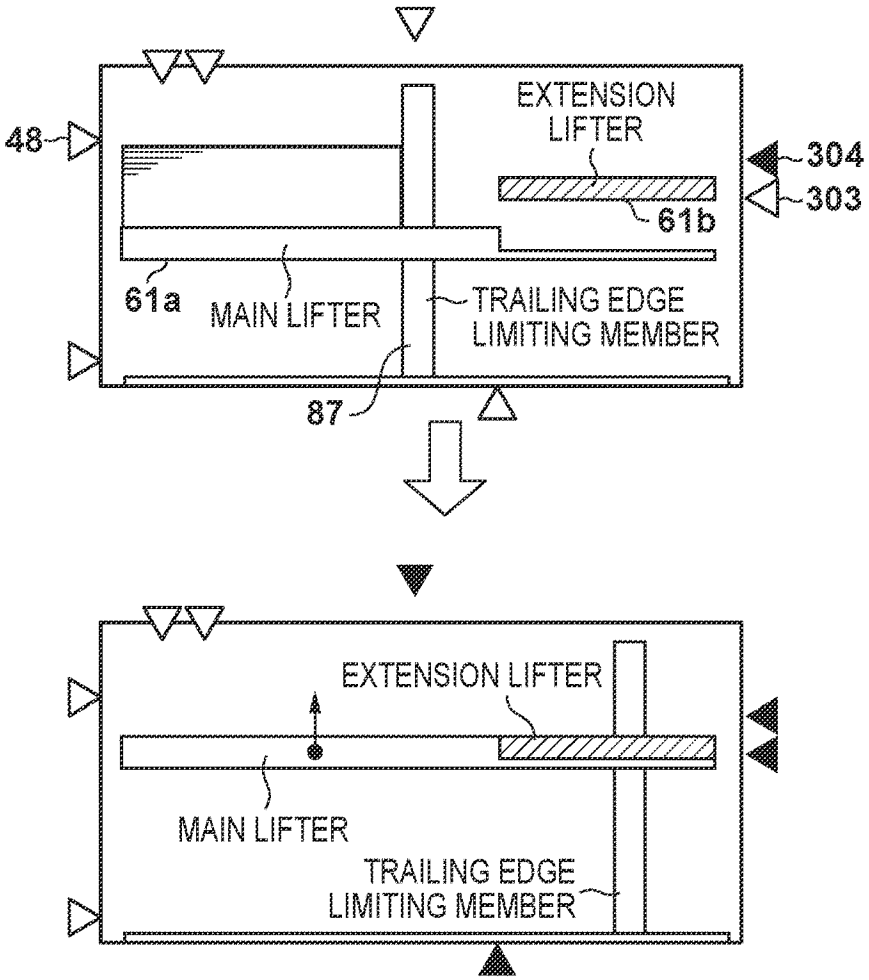
FIGS. 7A and 7B are views showing the positions of the main lifter and extension lifter, which correspond to the sheet remaining amount.
Figure 7A:
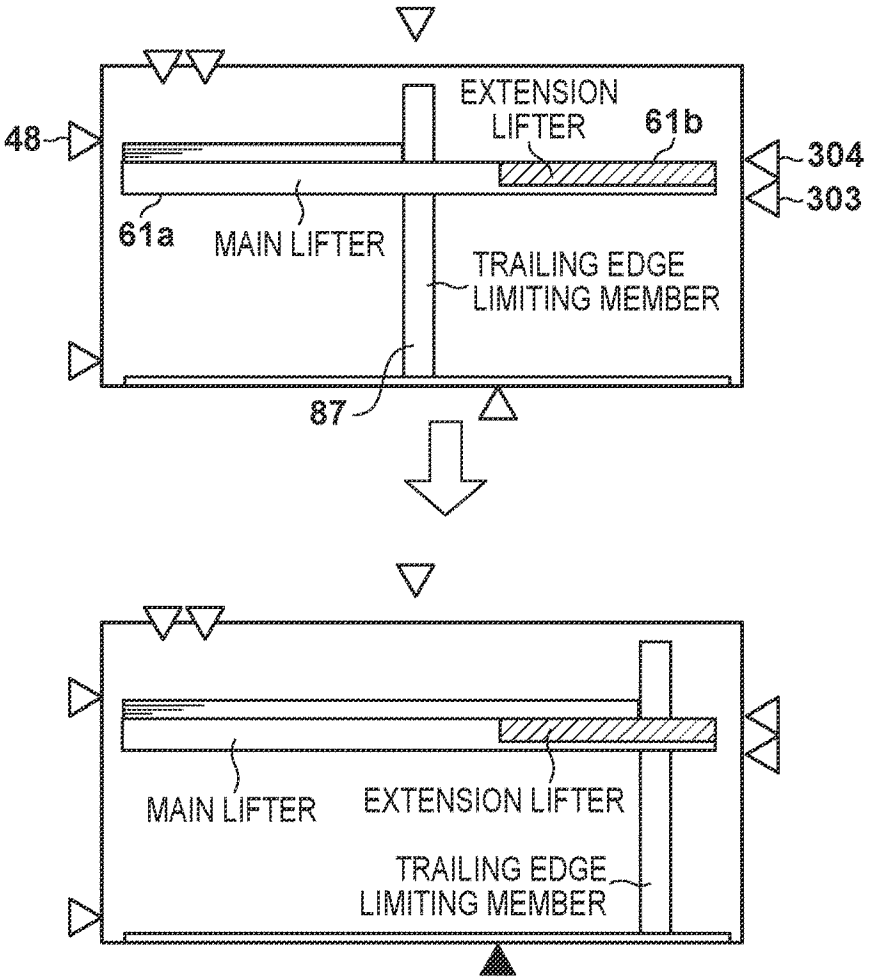

Sheets can be stacked on the lifter 61. As shown in FIGS. 7A and 7B, the lifter 61 is supported by a driving mechanism including a vertical movement motor so as to be movable upward and downward in the stacking direction (vertical direction, vertical movement direction). In addition, an upper surface sensor 50 is arranged on the upstream side of the pickup roller 51 above the lifter 61. The upper surface sensor 50 is positioned above the lifter 61, and senses, at the height of sheet feeding, the sheets S on the stacking member or the lifter 61 (an upper surface of the lifter 61) on which no sheets S are stacked. In this embodiment, the height of sheet feeding described above is the upper-limit position to which the lifter 61 can move upward.

The sheet feeding apparatus 30 includes the lifter 61, and two pairs of side limiting members 80 and 83. The side limiting members 80 and 83 can limit the side edge positions of the sheets S stacked on the lifter 61 in the widthwise direction (the direction of an arrow h in FIG. 2A) perpendicular to the feeding direction (the direction of the arrow b in FIG. 2A), and both of the side limiting members 80 and 83 can move in the widthwise direction.

In this embodiment, the pickup roller 51 can be urged against the uppermost one of the sheets S on the stacking member by applying an appropriate force to the uppermost sheet. The sheets S on the lifter 61 are separately fed one by one by the pickup roller 51 which vertically moves and rotates at a predetermined timing and the separation conveyor roller pair 31.

A connecting conveyance path 32 for feeding the sheet S from the paper deck 3000 to the pre-registration roller pair 130 of the apparatus main body 900 is formed in that portion of the paper deck 3000, which is connected to the apparatus main body 900. A sensor 14 senses a sheet on the conveyance path 32. In the large-capacity deck storage 62, the two pairs of side limiting members 80 and 83 are arranged on the two sides in the direction (the (widthwise) direction of the arrow h in FIG. 2A) perpendicular to the sheet feeding direction (the direction of the arrow b in FIG. 2A). The two pairs of side limiting members 80 and 83 can slide to the widths of all sheet sizes corresponding to the specifications, and can guide the sheets S on the lifter 61. That is, the side limiting members 80 and 83 are so supported as to be movable in the widthwise direction, and limit the two side positions of the stacked sheets S by abutting against the two side edges of the sheets S. Note that a leading edge limiting member 86 in FIG. 2A limits the leading edges of the sheets S on the lifter 61. Also, a trailing edge limiting member 87 is so arranged as to limit the trailing edges of the sheets S on the lifter 61. The trailing edge limiting member 87 is so supported as to be movable parallel to the sheet feeding direction (the direction of the arrow b), and limits the trailing edge positions of the sheets S. The trailing edge limiting member 87 can move along a positioning elongated hole 61*c* formed in the central portion of the lifter 61.

As shown in FIG. 2A, when the pickup roller 51 is driven to rotate in the direction of feeding the sheets S (the direction of an arrow a in FIG. 2A), the uppermost sheet S is fed in the direction of the arrow b. Consequently, the sheet S abuts against the nip portion of the separation conveyor roller pair 31 adjacent to the exit side of the pickup roller 51.

If multi feed occurs on the sheets S fed by the pickup roller 51, the following operation is performed. That is, the retard roller 13 which rotates in the direction opposite to that of the feed roller 12 which rotates in the same direction (the direction of an arrow c) as the arrow a rotates in the same direction as that of the feed roller 12 if two or more sheets S abut against the nip portion. Then, the retard roller 13 pushes the second and subsequent sheets S in the nip portion back in the direction of the lifter 61, and the feed roller 12 feeds only a single uppermost sheet S in the direction of the arrow b.

When the sheet S is fed from the paper deck 3000 having the above arrangement or from one of the feeding cassettes 1001 to 1004, the leading edge of the sheet S abuts against the nip portion of the pre-registration roller pair 130. The pre-registration roller pair 130 includes a pair of opposite rollers, and is arranged on the conveyance path of the sheets S so as to be rotatable in the direction of an arrow d in FIG.

2A. The sheet S which once abuts against the nip portion of the pre-registration roller pair 130 is conveyed into the apparatus main body 900 by the pre-registration roller pair 130 which rotates in synchronism with the feed timing.

Figure 2B:
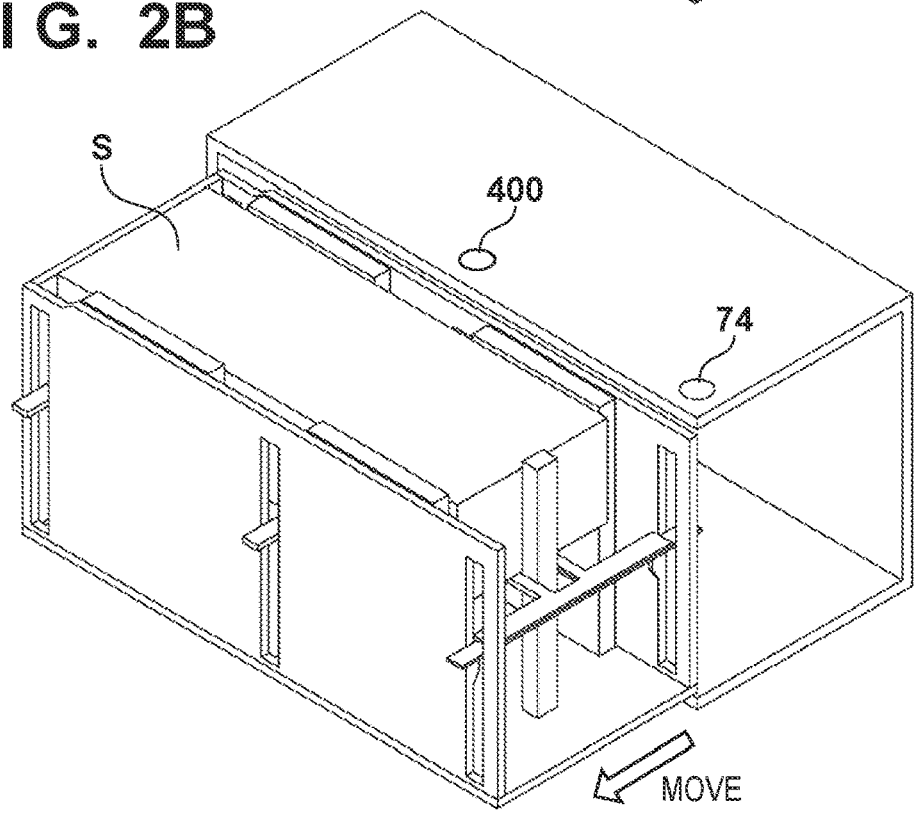

FIG. 2B is a view showing a state in which the large-capacity deck storage 62 is pulled out to the front side from the paper deck 3000. The large-capacity deck storage 62 is pulled out as shown in FIG. 2B when, for example, the user replenishes sheets, removes sheets remaining in the lifter 61, or performs mode switching (to be described later). As will be described later, the paper deck 3000 includes an LED 400 for notifying the user of the states of the main lifter 61*a* and extension lifter 61*b*, and an opening/closing instruction button 74 for accepting an instruction to pull out the large-capacity deck storage 62. The large-capacity deck storage 62 can be pulled out when the user presses the opening/closing instruction button 74.

The arrangement of the lifter 61 will be explained below.

Figure 3:
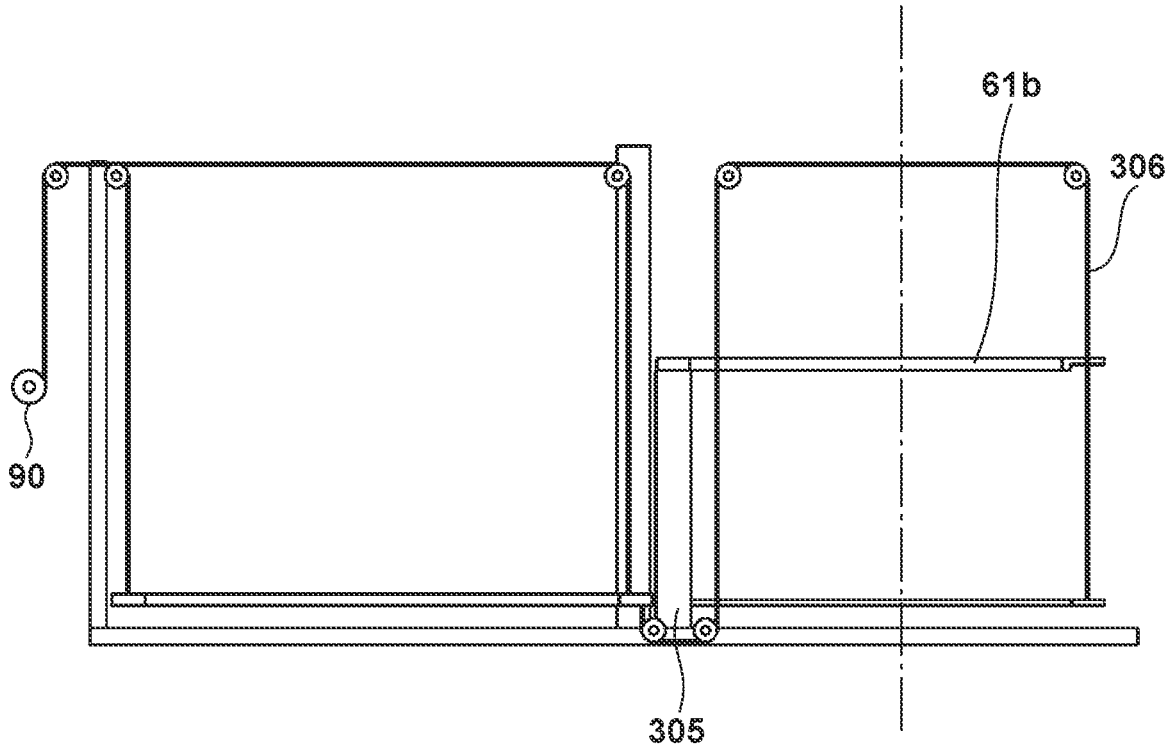
FIG. 3 is a view for explaining the structure of a lifter.

The lifter 61 includes the main lifter 61*a* and extension lifter 61*b*. As shown in FIG. 3, a plurality of wires are connected to the wire fulcrums of the main lifter 61*a*, and the main lifter 61*a* is suspended by these wires. When the wires are wound by a winding unit 90 connected to a vertical movement motor 55, the main lifter 61*a* moves upward. When the wires are fed, the main lifter 61*a* moves downward.

As shown in FIG. 3, the extension lifter 61*b* is installed as it is supported by an extension lifter support member 305 and the large-capacity deck storage 62. Note that FIG. 3 does not show the large-capacity deck storage 62. The extension lifter 61*b* can be coupled with the main lifter 61*a* on a level higher than a position of the support height and lower than an upper-limit position, and can move in cooperation with the main lifter 61*a*. That is, the extension lifter 61*b* itself has no driving power. For example, when the main lifter 61*a* exists above the support height of the extension lifter 61*b*, the extension lifter 61*b* is coupled with the main lifter 61*a* and moves together with the main lifter 61*a*. On the other hand, if the main lifter 61*a* exists below the support height of the extension lifter 61*b* (lower than a position of the support height and higher than a lower-limit position), the extension lifter 61*b* waits at the support height. The support height is a predetermined height set in consideration of the driving power and strength of the lifter 61. This step between the lifters makes the number of elongated paper sheets SL to be stacked fall within the allowable range of the sheet feeding apparatus 30.

In this embodiment, the extension lifter 61*b* can be interlocked with the main lifter 61*a* on the orbit of the main lifter 61*a*. FIG. 3 shows the extension lifter 61*b* and a wire 306 positioned on the most upstream side with respect to the feeding direction, and the alternate long and short dashed line indicates the center of gravity of the extension lifter 61*b*. The wire 306 positioned on the most upstream side with respect to the feeding direction is installed on the right side of the center of gravity of the extension lifter 61*b*. Since this arrangement stabilizes the posture of the extension lifter 61*b*, it is possible to reduce the operation noise generated when the extension lifter 61*b* comes in contact with and moves away from the main lifter 61*a*.

Two modes which the sheet feeding apparatus 30 uses in accordance with the types of sheets to be stacked will be explained below. In this embodiment, the types of sheets are roughly classified into two types. One is a plain paper sheet such as A3 and A4, and the other is an elongated paper sheet longer than the plain paper sheet in the feeding/conveyance direction. Sheets to be stacked on the lifter 61 are sorted into plain and elongated paper sheets in accordance with the position of the trailing edge limiting member 87. A trailing edge limiting member position sensor 302 shown in FIGS. 4A and 4B senses the position of the trailing edge limiting member 87. In this embodiment, the plain paper mode and elongated paper mode are switched in accordance with the position of the trailing edge limiting member 87 described above. However, the user may also set these modes by operating an operation panel 40.

Figure 4A:
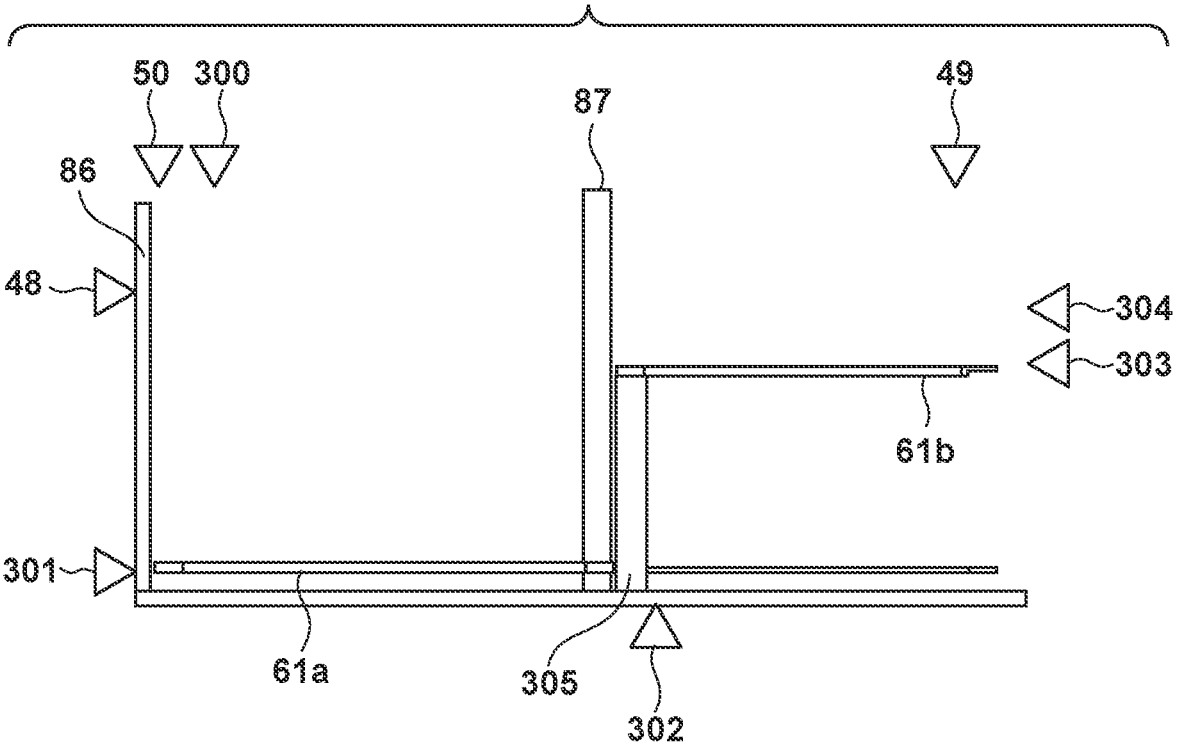
FIGS. 4A and 4B are views showing the positions of sensors.
Figure 5A:
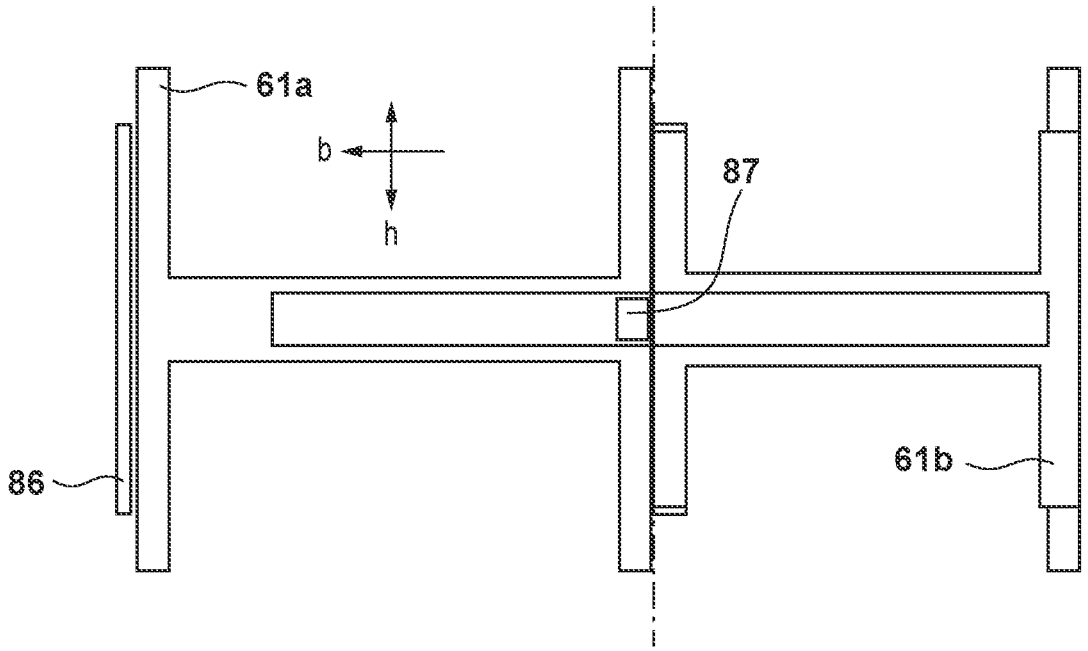
FIGS. 5A and 5B are views showing the position of a trailing edge limiting member.

When the trailing edge limiting member 87 exists on the left side of the alternate long and short dashed line as shown in FIG. 5A, it is determined that sheets to be stacked on the lifter 61 are plain paper sheets. In this embodiment, this state is called a plain paper mode. In this plain paper mode, as shown in FIG. 4A, the lifter 61 can move downward to a lower-limit position sensible by a lower-limit position sensor 301, so a large amount of sheets can be stacked.

Figure 4B:
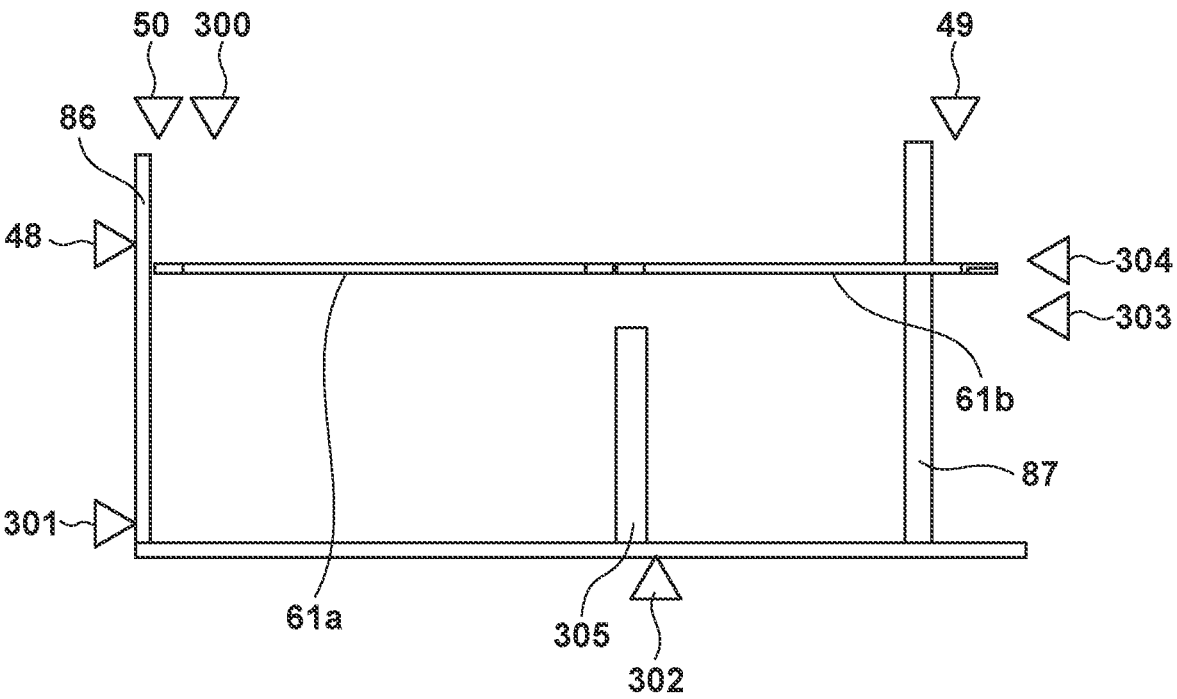
Figure 5B:
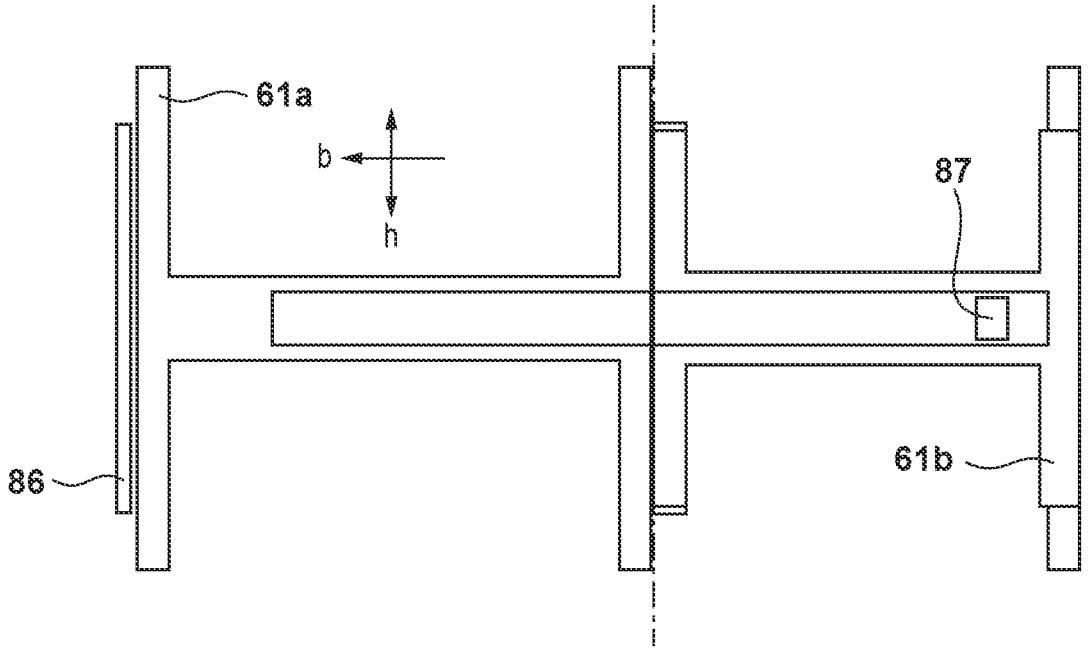

On the other hand, when the trailing edge limiting member 87 exists on the right side of the alternate long and short dashed line as shown in FIG. 5B, it is determined that sheets to be stacked on the lifter 61 are elongated paper sheets. In this embodiment, this state will be called an elongated paper mode. In this elongated paper mode, as shown in FIG. 4B, the lifter 61 can move downward only to a position sensible by an extension lifter HP sensor 304, so the number of stackable sheets is restricted compared to that of the plain paper mode.

The elongated paper mode is switched to the plain paper mode when the user moves the trailing edge limiting member 87 from the right side to the left side of the alternate long and short dashed line as shown in FIG. 5A. Likewise, the plain paper mode is switched to the elongated paper mode when the user moves the trailing edge limiting member 87 from the left side to the right side of the alternate long and short dashed line as shown in FIG. 5B. This embodiment will be explained by taking the plain paper mode and elongated paper mode as examples. However, the types of sheets are not limited to the plain and elongated paper sheets as long as the relationship between a sheet having a first size and a sheet having a second size larger than the first size holds.

The positions of sensors formed in the sheet feeding apparatus 30 will be explained below with reference to FIGS. 4A and 4B. A main lifter position sensor 303 is formed in a position corresponding to a case in which the number of sheets stacked on the main lifter 61*a* is 1,000, and senses the main lifter 61*a* in that position. The extension lifter HP sensor 304 is formed in a position corresponding to a case in which the number of sheets stacked on the extension lifter 61*b* is 1,000, and senses the extension lifter 61*b* or a sheet in that position. The position corresponding to the cases in which the numbers of sheets stacked on the main lifter 61*a* and extension lifter 61*b* are 1,000 is also the position of the support height described earlier. A relay sensor 48 is formed in a position corresponding to a case in which the number of sheets stacked on the main lifter 61*a* is smaller than 1,000, for example, 850, and senses the main lifter 61*a* or a sheet in that position. A foreign substance sensor 49 senses the presence/absence of a sheet or foreign substance on the extension lifter 61*b*. A sheet presence/absence sensor 300 senses the presence/absence of a sheet or foreign substance on the main lifter 61*a*. When the user opens the storage (cover), the upper surface of the lifter moves downward to the position of the relay sensor 48 and stops there in order to facilitate replenishing sheets. If a sheet is stacked on the lifter, the upper surface of the sheet moves downward to the position of the relay sensor 48 and stops there.

Figure 10:
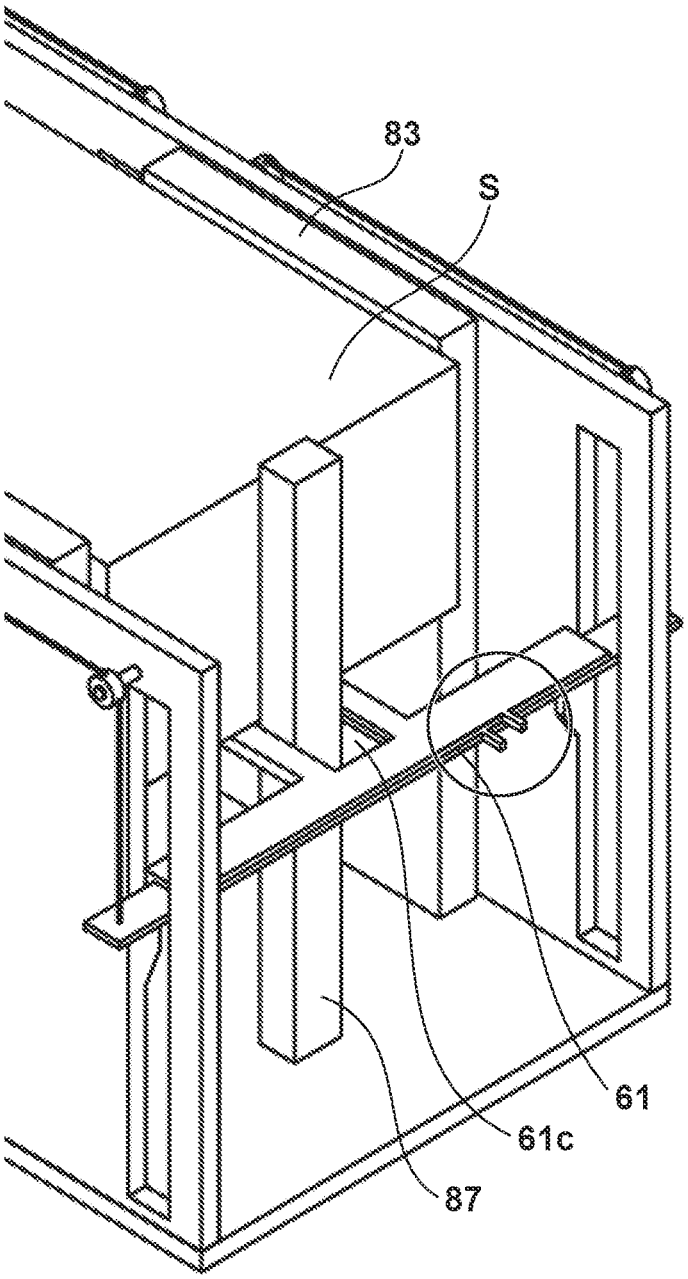
FIG. 10 is a view showing a main lifter position sensor and extension lifter HP sensor.
Figure 11:
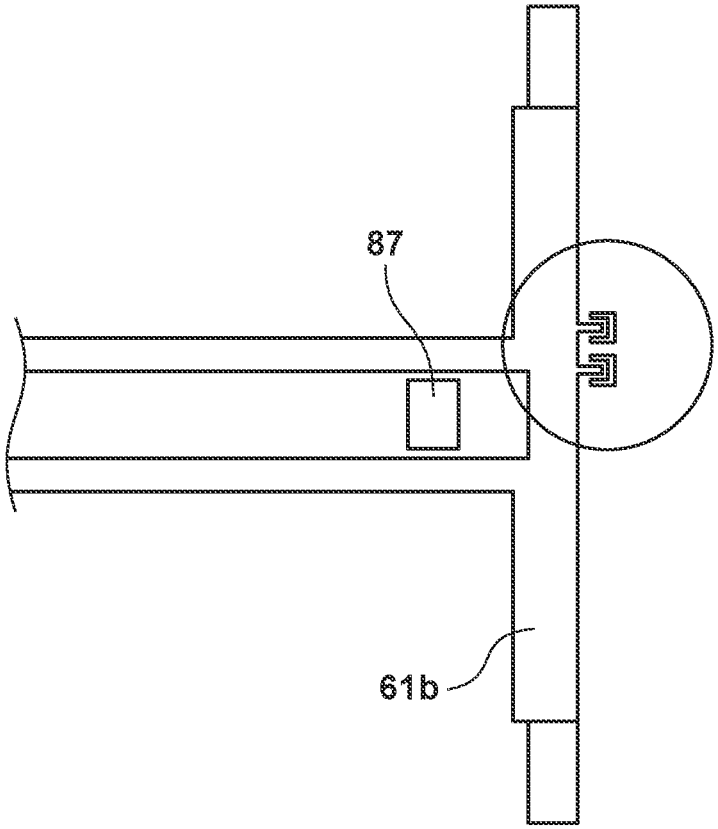
FIG. 11 is a view showing the main lifter position sensor and extension lifter HP sensor.

The main lifter position sensor 303 and extension lifter HP sensor 304 are formed as, for example, U-shaped sensors using interrupters as shown in FIGS. 10 and 11. FIG. 10 is a view obliquely showing flags formed on the main lifter 61*a* and extension lifter 61*b*. FIG. 11 is a view showing the flag from above. FIG. 11 shows a state in which the flags are inserted into the U-shapes.

Figure 6A:
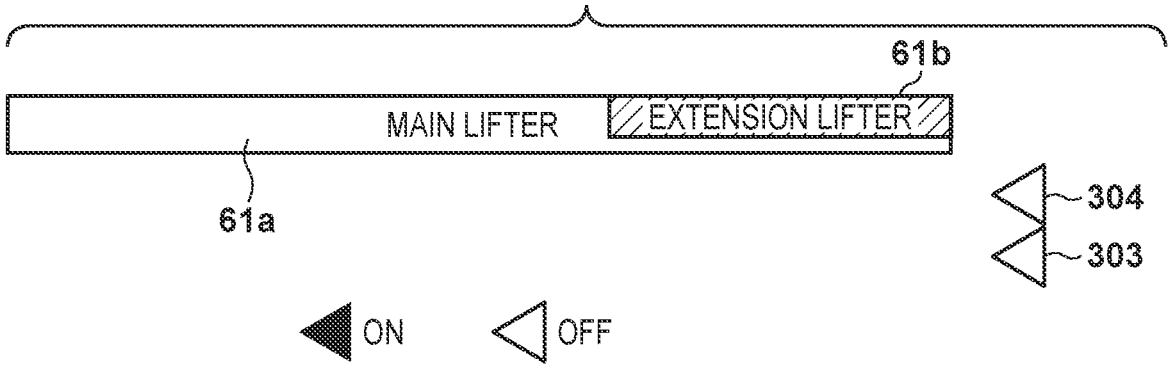
FIGS. 6A, 6B, and 6C are views showing the positions of a main lifter and extension lifter.
Figure 6B:
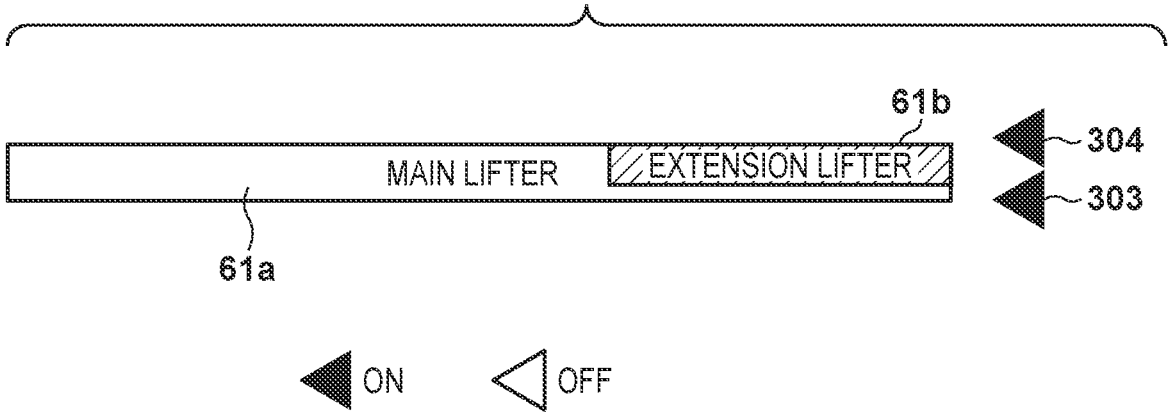
Figure 6C:
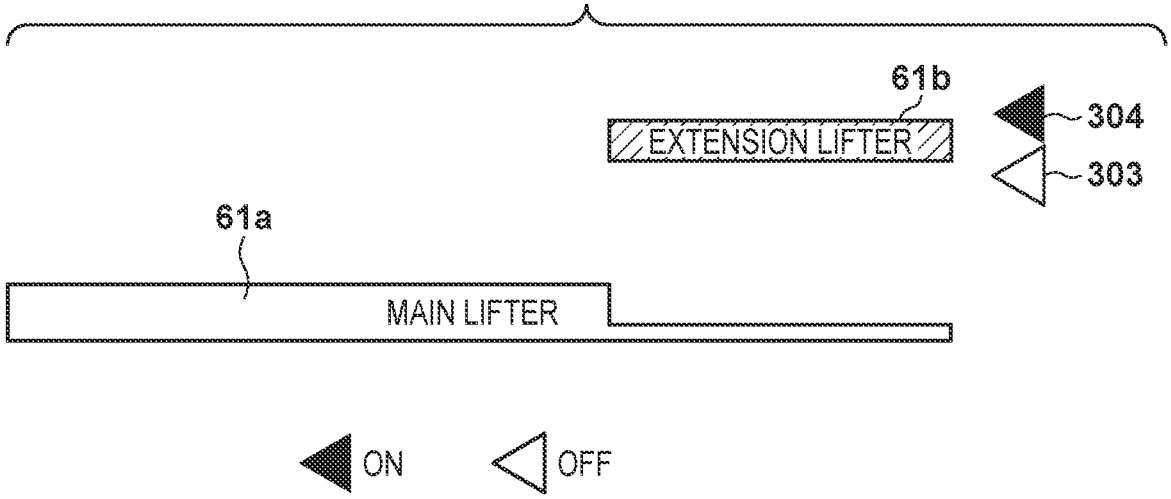

As shown in FIGS. 6A to 6C, whether the main lifter 61*a* and extension lifter 61*b* are synchronized can be determined by the combination of ON/OFF of the main lifter position sensor 303 and extension lifter HP sensor 304. "Synchronized" means a state in which there is no step between the main lifter 61*a* and extension lifter 61*b*, and "not synchronized" means a state in which there is a step between the main lifter 61*a* and extension lifter 61*b*.

FIG. 6A shows a case in which the main lifter 61*a* and extension lifter 61*b* operate together and exist above the main lifter position sensor 303 and extension lifter HP sensor 304. In this example, this is a case in which the two lifters exist above the position when the number of stacked sheets is 1,000. In this case, both of the two sensors are turned off. FIG. 6B shows a case in which the main lifter 61*a* and extension lifter 61*b* are at the support height of the extension lifter support member 305. In this example, this is a case in which the two lifters exist in the position when the number of stacked sheets is 1,000. In this case, both of the two sensors are turned on. FIG. 6C shows a case in which the main lifter 61*a* is lower than the support height of the extension lifter support member 305, and the extension lifter 61*b* is at the support height. In this example, this is a case in which the main lifter 61*a* is lower than the position when the number of stacked sheets is 1,000. In this case, the main lifter position sensor 303 is turned off, and the extension lifter HP sensor 304 is turned on.

The step between the lifters is produced in accordance with, for example, the stacked amount of remaining sheets in the storage. As shown in FIG. 7A, when the number of remaining sheets is less than a predetermined amount (for example, less than 150 sheets), the main lifter 61*a* and extension lifter 61*b* are synchronized in a horizontal state having no step. In this state, the user can set elongated paper by removing the remaining sheets, and sliding the trailing edge limiting member 87 to the side (the right side in FIG. 7A) behind the trailing edge limiting member position sensor 302.

On the other hand, as shown in FIG. 7B, when the number of remaining sheets is equal to or larger than the predetermined amount (for example, 150 sheets), the main lifter 61*a* and extension lifter 61*b* are not synchronized in a state having a step. In this state, the user first removes the remaining sheets and slides the trailing edge limiting member 87 to the side (the right side in FIG. 7B) behind the trailing edge limiting member position sensor 302. When the user closes the storage after that, a lifter synchronizing operation is performed, and this makes elongated paper sheets stackable. Note that the threshold is 150 sheets in this embodiment, but the threshold is not limited to this value and can be changed to various values in accordance with the configuration. For example, when the apparatus is configured to sense sheets one by one, it is possible to determine the presence/absence of remaining sheets in addition to the presence/absence of a step between the main lifter 61*a* and extension lifter 61*b*.

As described above, since a large amount of remaining sheets in the sheet feeding apparatus 30 produces a step between the lifters, the process of synchronizing the lifters is necessary in order to make elongated paper sheets settable. Therefore, the sheet feeding apparatus 30 of this embodiment checks whether remaining sheets equal to or more than the predetermined amount are stacked.

Figure 8A:
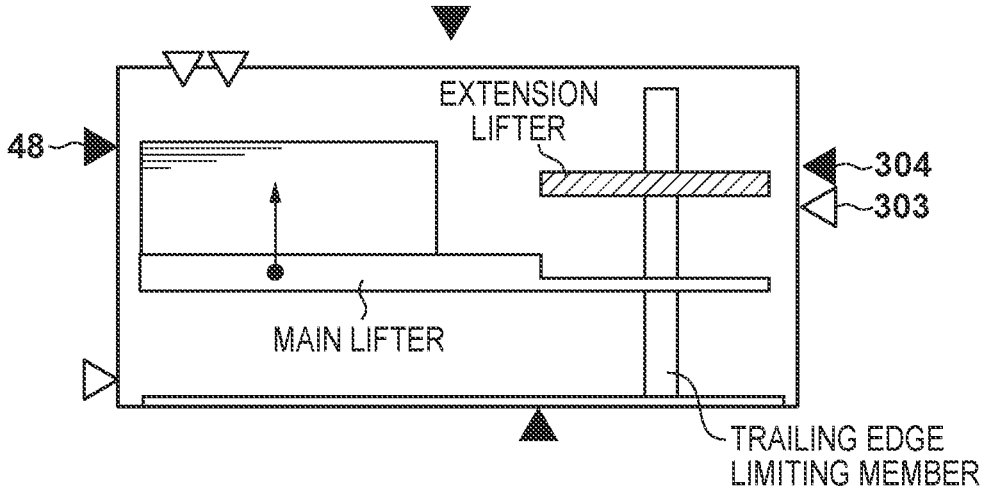
FIGS. 8A and 8B are views showing the positions of the main lifter and extension lifter, which correspond to the presence/absence of remaining sheets.
Figure 8B:
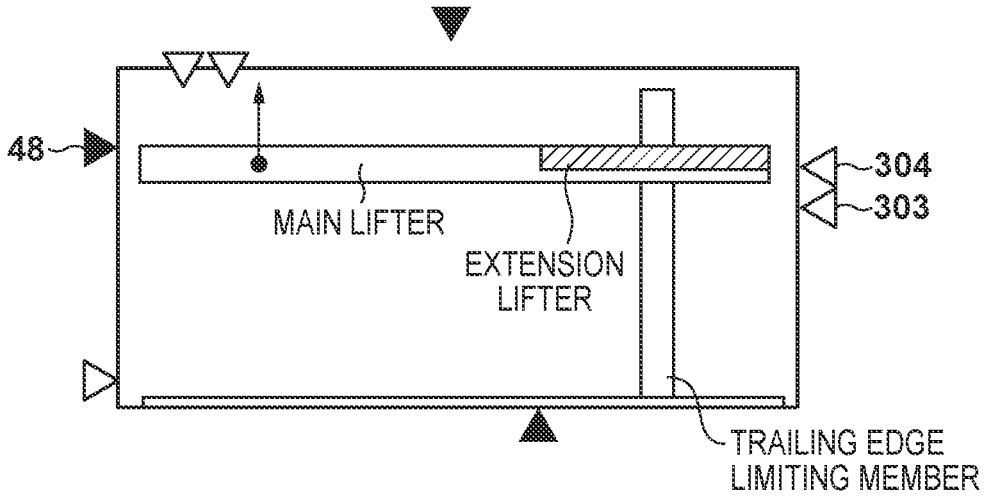

In this embodiment, remaining sheets are checked based on the reaction order (sensing order) of the main lifter position sensor 303 and relay sensor 48. As shown in FIG. 8B, when the user removes a large amount of (for example, 150 or more) remaining sheets and closes the storage, the main lifter 61*a* moves upward for the synchronizing operation. Consequently, the main lifter position sensor 303 and relay sensor 48 react in this order when moving upward. In other words, a detection by the relay sensor 48 is performed after a detection by the main lifter position sensor 303. On the other hand, if remaining sheets are left unremoved as shown in FIG. 8A, the relay sensor 48 reacts first when moving upward. That is, in this embodiment, the user is notified of the necessity of sheet removal when the relay sensor 48 reacts first. As a consequence, the user is rapidly notified, so the waiting time of the user can be shortened.

Figure 12:
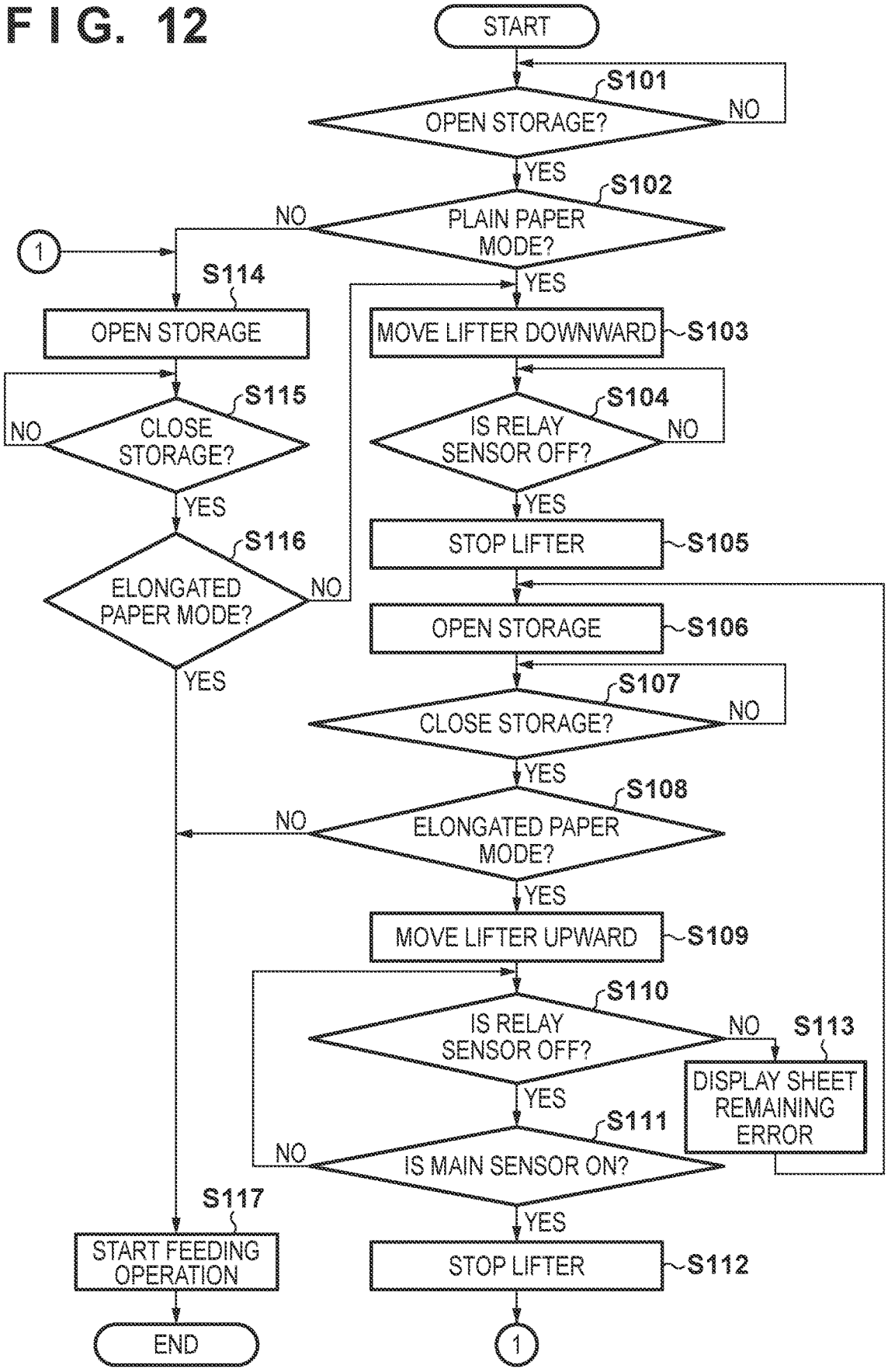
FIG. 12 is a flowchart showing a process of detecting the presence/absence of remaining sheets.

FIG. 12 is a flowchart showing the remaining sheet determination process according to this embodiment. Each processing in FIG. 12 is implemented by, for example, the CPU of the control unit 41 (to be simply referred to as the CPU hereinafter) by reading out a program stored in the ROM to the RAM and executing the program. The process of FIG. 12 is started when the user switches the modes or opens the storage in order to remove remaining sheets in the sheet feeding apparatus 30.

In step S101, the CPU waits for a storage opening instruction. This determination is performed based on whether the opening/closing instruction button 74 is pressed. If the storage opening instruction is received, the CPU determines in step S102 whether the plain paper mode is set, based on the position of the trailing edge limiting member 87. If it is determined that the plain paper mode is set, the process advances to step S103. If it is determined that the plain paper mode is not set, the process advances to step S114.

In steps S103, S104, and S105, the CPU moves the main lifter 61*a* downward and stops the main lifter 61*a* when the relay sensor 48 is turned off. In step S106, the CPU opens the storage. At this point of time, the user can remove remaining sheets in the storage, switch the modes, and insert sheets. In step S107, the CPU waits for the storage to be closed. When the storage is closed, the process advances to step S108.

In step S108, the CPU determines whether the elongated paper mode is set, based on the position of the trailing edge limiting member 87. If it is determined that the elongated paper mode is set, that is, if the modes are switched, the process advances to step S109. On the other hand, if it is determined that the elongated paper mode is not set, for example, if sheets are inserted in the plain paper mode, the process advances to step S117. In step S117, the CPU starts an operation of feeding sheets (plain paper sheets) from the sheet feeding apparatus 30.

When the process advances to step S109, the plain paper mode has been switched to the elongated paper mode. In this embodiment, whether remaining sheets equal to or more than a predetermined amount are stacked is determined based on the order of reactions of the sensors to the movement of the main lifter 61*a*.

In step S109, the CPU moves the main lifter 61*a* upward. In step S110, the CPU determines whether the relay sensor 48 is OFF. If it is determined that the relay sensor 48 is OFF, the process advances to step S111. If it is determined that the relay sensor 48 is not OFF, that is, is ON, the process advances to step S113. When the process advances to step S113, the relay sensor 48 has reacted first because remaining sheets are stacked on the main lifter 61*a*. Therefore, the CPU performs remaining error notification by, for example, displaying a warning indicating the presence of remaining sheets on the operation panel 40. It is also possible to display an instruction to open the storage, in addition to the warning. After step S113, the CPU repeats the process from step S106.

In step S111, the CPU determines whether the main lifter position sensor 303 is ON. If it is determined that the main lifter position sensor 303 is ON, the process advances to step S112. If it is determined that the main lifter position sensor 303 is not ON, that is, is OFF, the CPU repeats the process from step S110. When the process advances to step S112, the main lifter position sensor 303 and relay sensor 48 have reacted in this order as the main lifter 61*a* moves upward because no remaining sheets are stacked on the main lifter 61*a*. In step S112, the CPU stops the upward movement of the main lifter 61*a*. At this point of time, the apparatus is standing by in the elongated paper mode (elongated paper can be inserted).

If it is determined after step S112 or in step S102 that the plain paper mode is not set, the CPU opens the storage in step S114. At this point of time, the user can remove remaining sheets in the storage, switch the modes, and insert sheets. In step S115, the CPU waits for the storage to be closed. When the storage is closed, the process advances to step S116.

In step S116, the CPU determines whether the elongated paper mode is set, based on the position of the trailing edge limiting member 87. If it is determined that the elongated paper mode is set, the process advances to step S117. In step S117, the CPU starts an operation of feeding sheets (elongated paper) from the sheet feeding apparatus 30. On the other hand, if it is determined that the elongated paper mode is not set, that is, if it is determined that the plain paper mode is set, the process advances to step S103.

A case in which it is determined in step S116 after step S112 that the elongated paper mode is set is a case in which elongated paper sheets are inserted in the elongated-paper-mode standby state, so the CPU starts an elongated paper feeding operation in step S117. A case in which it is determined in step S116 after step S112 that the elongated paper mode is not set is a case in which the mode is switched to the plain paper mode from the elongated-paper-mode standby state. In this case, the CPU performs the process from step S103 again. If the plain paper mode is kept set because, for example, plain paper is inserted, the process advances from step S108 to step S117, and the CPU starts a plain paper feeding operation. Also, if the mode is switched to the elongated paper mode again, the CPU determines whether remaining sheets equal to or more than the predetermined amount are stacked after step S109, in order to set the elongated-paper-mode standby state.

A case in which it is determined in step S116 after step S102 that the elongated paper mode is set is a case in which the elongated paper feeding operation is performed last time, so the CPU opens the storage to allow the user to remove remaining sheets in the storage, switch the modes, and insert sheets. If it is determined in step S116 that the elongated paper mode is set because elongated paper is inserted, the CPU performs the elongated paper feeding operation in step S117. If the mode is switched to the plain paper mode, the CPU determines in step S116 that the plain paper mode is set, and performs the process from step S103.

In this embodiment as described above, remaining sheets on the main lifter 61*a* are checked based on the reaction order of the relay sensor 48 and main lifter position sensor 303. Therefore, it is possible to rapidly notify the user when remaining sheets equal to or more than the predetermined amount are stacked.

Figure 9:
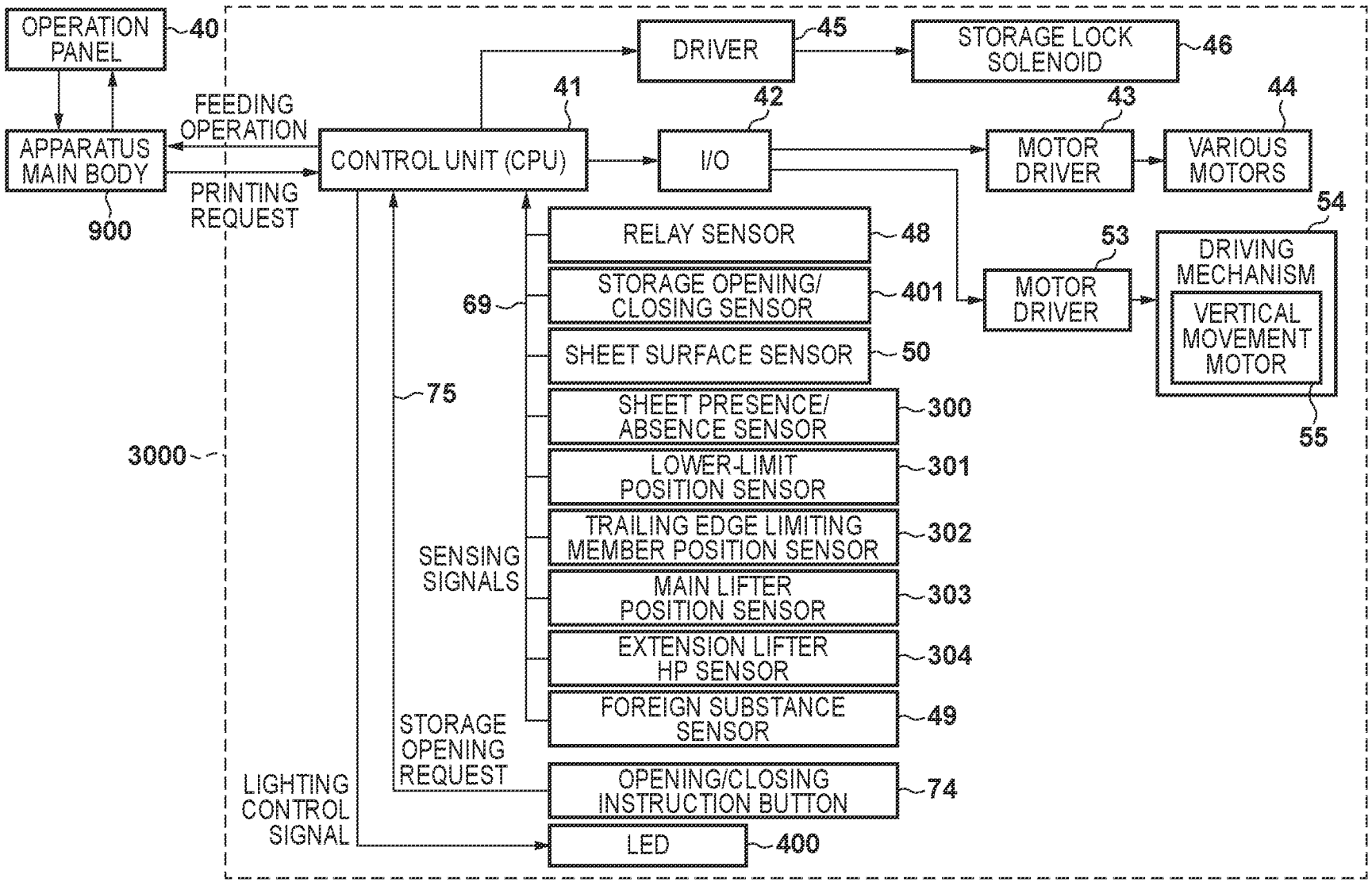
FIG. 9 is a view showing a block configuration of the image forming apparatus including the feeding apparatus.

FIG. 9 is a view showing the block configuration of the image forming apparatus 1000 for implementing the operation of this embodiment. FIG. 9 shows the paper deck 3000, apparatus main body 900, and operation panel 40. The operation panel 40 displays various user interface screens such as apparatus information, a setting screen, and job information, and accepts instructions and setting operations from the user. The operation panel 40 is formed on the apparatus main body 900. The apparatus main body 900 issues a printing request to the control unit 41 of the paper deck 3000. When receiving this printing request from the apparatus main body 900, the control unit 41 performs a feeding operation for the apparatus main body 900.

The control unit 41 comprehensively controls the paper deck 3000. For example, when receiving an opening/closing request signal input by the user by pressing the opening/closing instruction button 74, the control unit 41 cancels the locked state of a storage lock solenoid 46 via a driver 45, thereby opening the storage. The control unit 41 drives various motors 44 on the sheet conveyance path via a motor driver 43 connected to an input/output interface (I/O) 42. Also, the control unit 41 controls a driving mechanism 54 for vertically moving the main lifter 61*a* and extension lifter 61*b* via a motor driver 53 connected to the input/output interface (I/O) 42. The driving mechanism 54 includes the vertical movement motor 55. The vertical movement motor 55 drives the winding unit 90 shown in FIG. 3.

Sensing signals from the relay sensor 48, storage opening/closing sensor 401, upper surface sensor 50, and sheet presence/absence sensor 300 are transmitted to the control unit 41. The storage opening/closing sensor 401 is a sensor for sensing the opening/closing state of the storage. Sensing signals from the lower-limit position sensor 301, trailing edge limiting member position sensor 302, main lifter position sensor 303, extension lifter HP sensor 304, and foreign substance sensor 49 are transmitted to the control unit 41. In addition, a storage opening/closing request signal generated by the user by pressing the opening/closing instruction button 74 is transmitted to the control unit 41.

The control unit 41 controls lighting of the LED 400 by a lighting control signal for the LED 400. This lighting control of the LED 400 will be explained in the second embodiment.

Second Embodiment

In this embodiment, a configuration which notifies the user of whether the main lifter 61*a* and extension lifter 61*b* are synchronized, that is, whether there is a step between them (information on the positional relationship) will be explained. Differences from the first embodiment will be explained below.

As shown in FIG. 2B, the LED 400 is formed on the sheet feeding apparatus 30, and the user is notified of the state between the main lifter 61*a* and extension lifter 61*b* by a plurality of types of lighting patterns of the LED 400.

These lighting patterns of the LED 400 will be explained below. Table 1 shows all the lighting patterns of the LED 400 in the individual modes.

TABLE 1

| | Plain paper mode | Elongated paper mode |
|---|---|---|
| Lifters are not synchronized | OFF | Blinking |
| Lifters are synchronized | OFF | ON |

The LED 400 determines the individual modes described above and determines whether the main lifter 61*a* and extension lifter 61*b* are synchronized, based on the trailing edge limiting member position sensor 302, main lifter position sensor 303, and extension lifter HP sensor 304. Then, the LED 400 shows the determination result by a lighting method using three patterns, that is, ON/OFF/blinking, so that the user can identify the state of the storage. That is, the state between the main lifter 61*a* and extension lifter 61*b* is determined based on the ON/OFF combination of the main lifter position sensor 303 and extension lifter HP sensor 304.

As shown in Table 1, the LED 400 is turned off in the state of the plain paper mode, regardless of whether the main lifter 61*a* and extension lifter 61*b* are synchronized. This is so because a sheet setting change from plain paper to plain paper is possible regardless of whether the main lifter 61*a* and extension lifter 61*b* are synchronized. The user can recognize that a sheet setting change from plain paper to plain paper is possible because the LED 400 is turned off.

The LED 400 is turned on when the main lifter 61*a* and extension lifter 61*b* are synchronized in the state of the elongated paper mode. The user can recognize that a sheet setting change from elongated paper to elongated paper or from elongated paper to plain paper is possible because the LED 400 is turned on.

The LED 400 is blinking when the main lifter 61*a* and extension lifter 61*b* are not synchronized in the state of the elongated paper mode. Since the main lifter 61*a* and extension lifter 61*b* are not synchronized in this state, a sheet setting change from plain paper to elongated paper cannot be performed. Accordingly, it is necessary to cause the user to close the storage and perform the operation of synchronizing the main lifter 61*a* and extension lifter 61*b*. The user can recognize that the main lifter 61*a* and extension lifter 61*b* are not synchronized because the LED 400 is blinking. Information as shown in Table 1 is stored in, for example, the ROM of the control unit 41.

Figure 13A:
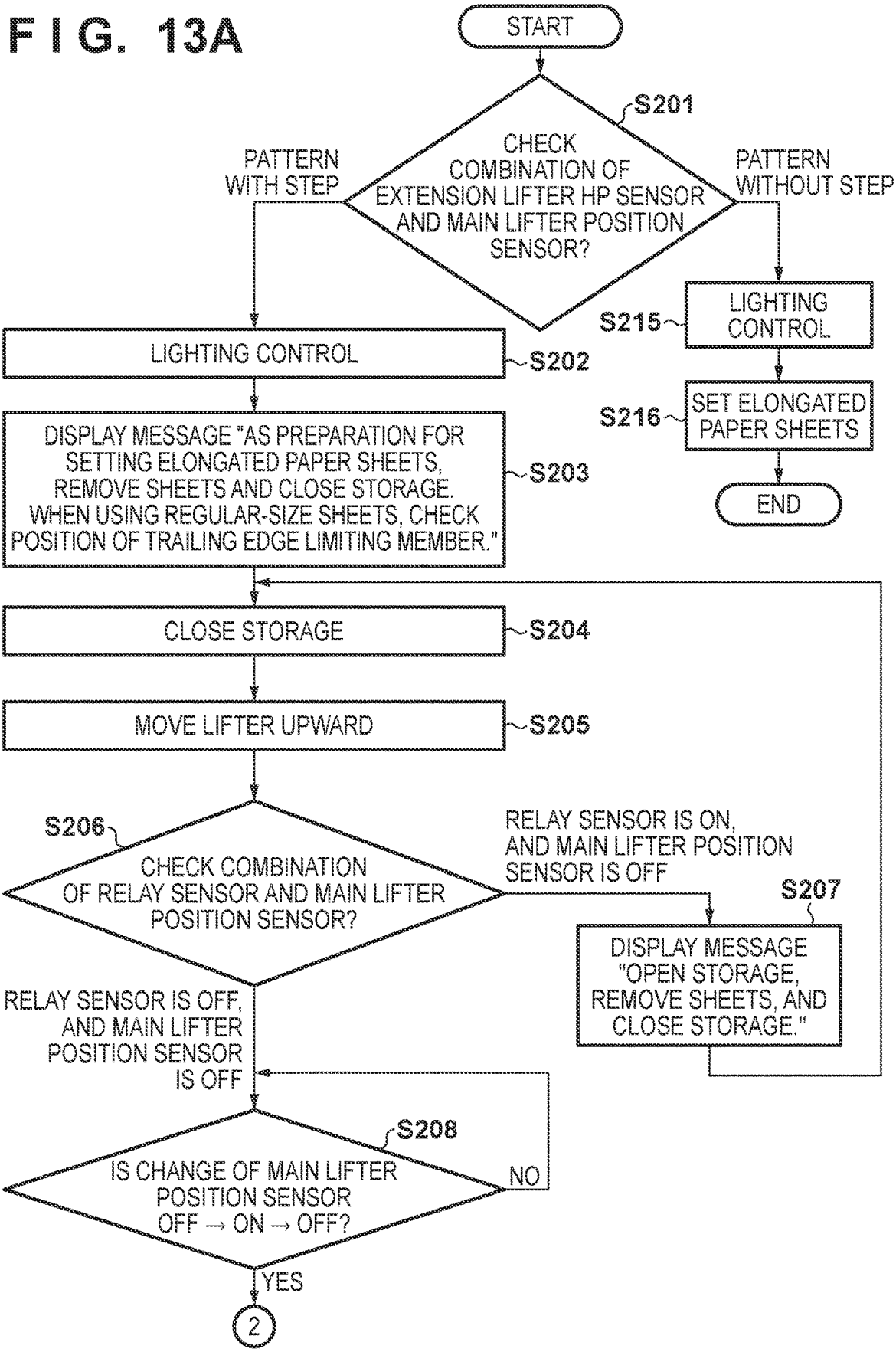
FIGS. 13A and 13B are flowcharts showing processes of setting elongated paper sheets.
Figure 13B:
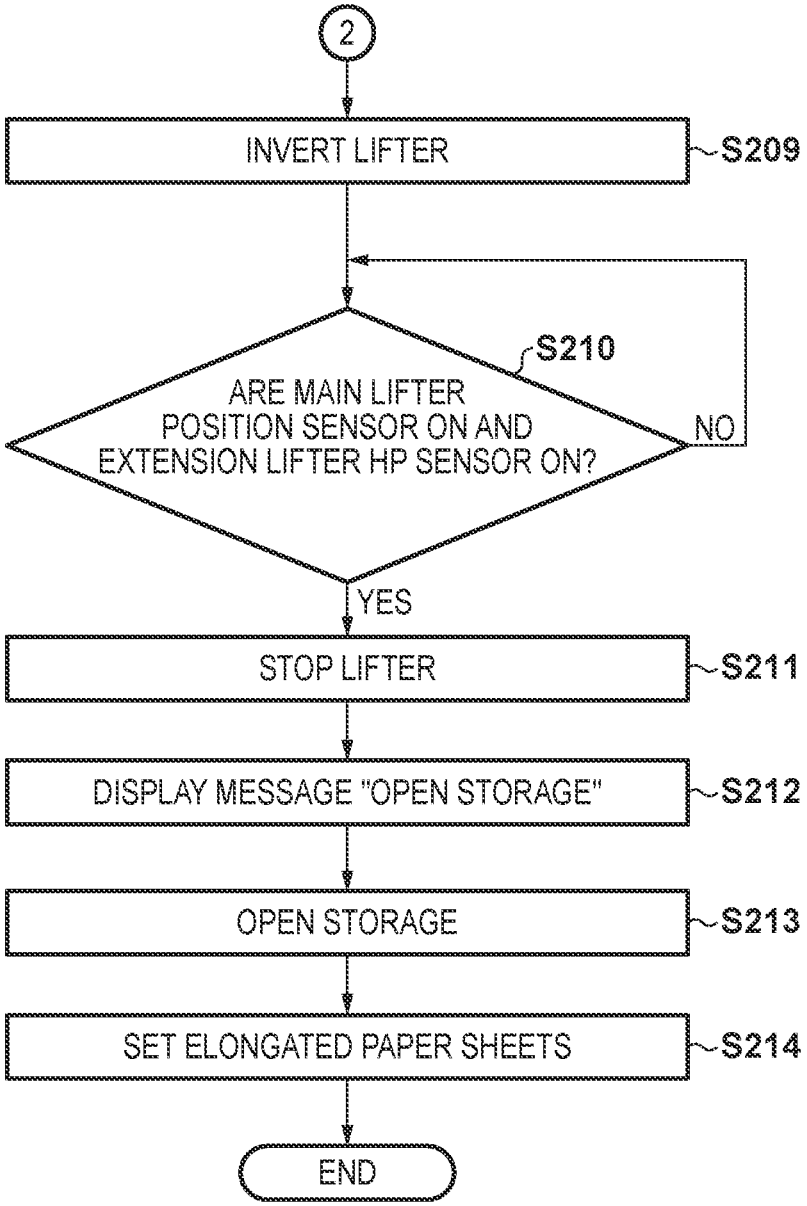

FIGS. 13A and 13B are flowcharts showing the process of setting elongated paper according to this embodiment. Each processing in FIGS. 13A and 13B is implemented by the CPU of the control unit 41 (to be simply referred to as the CPU hereinafter) by reading out a program stored in the ROM to the RAM and executing the program. The process of FIGS. 13A and 13B is started when it is detected that the trailing edge limiting member position sensor 302 is turned on, that is, the elongated paper mode is set.

In step S201, the CPU checks the combination of sensing results from the main lifter position sensor 303 and extension lifter HP sensor 304. When the main lifter position sensor 303 is OFF and the extension lifter HP sensor 304 is ON, there is a step between the two lifters, so the process advances to step S202, and the CPU blinks the LED 400. On the other hand, if the main lifter position sensor 303 and extension lifter HP sensor 304 are ON, there is no step between the two lifters, so the process advances to step S215, and the CPU turns on the LED 400. After step S215, the CPU accepts setting of elongated paper in step S216. After step S216, the CPU terminates the process of FIGS. 13A and 13B.

In step S203 after step S202, the CPU displays a message for setting elongated paper sheets on the operation panel 40. For example, the CPU displays a message "As preparation for setting elongated paper sheets, remove sheets and close the storage. When using regular size, check the position of the trailing edge limiting member."

If the CPU detects in step S204 that the storage is closed, the CPU moves the main lifter 61*a* upward in step S205. In step S206, the CPU checks the combination of sensing results from the relay sensor 48 and main lifter position sensor 303. If the relay sensor 48 is ON and the main lifter position sensor 303 is OFF, the process advances to step S207, and the CPU causes the operation panel 40 to display a message for urging the user to perform an operation of removing remaining sheets. For example, the CPU displays a message "Open the storage, remove sheets, and close the storage." After step S207, the CPU repeats the process from step S204. This is so because the relay sensor 48 is turned on before the main lifter position sensor 303 is turned on because there are remaining sheets on the main lifter 61*a*, as explained in the first embodiment.

On the other hand, if the relay sensor 48 is OFF and the main lifter position sensor 303 is OFF, the process advances to step S208. In step S208, the CPU waits for the main lifter position sensor 303 to change in the order of OFF→ON→OFF. When the main lifter position sensor 303 changes in the order of OFF→ON→OFF, the CPU inverts the movement of the main lifter 61*a* (that is, moves the main lifter 61*a* downward) in step S209.

In steps S210 and S211, the CPU moves the main lifter 61*a* downward until the main lifter position sensor 303 is turned on and the extension lifter HP sensor 304 is turned on. When the main lifter position sensor 303 is turned on and the extension lifter HP sensor 304 is turned on, the process advances to step S212, and the CPU causes the operation panel 40 to display a message for urging the user to open the storage. The CPU opens the storage in step S213, and accepts setting of elongated paper in step S214. After that, the CPU terminates the process of FIGS. 13A and 13B.

In this embodiment, the main lifter position sensor 303 and extension lifter HP sensor 304 sense the main lifter 61*a* and extension lifter 61*b* at the above-described support height corresponding to the case in which the number of stacked sheets on the main lifter 61*a* and extension lifter 61*b* is 1,000. However, another arrangement may also be adopted. For example, at least the extension lifter HP sensor 304 may also sense the extension lifter 61*b* at the above-mentioned support height. A position in which the main lifter 61*a* and extension lifter 61*b* are reliably integrated and elongated paper sheets can be stacked is determined at a position higher than the support height. That is, this position is a position at which the extension lifter HP sensor 304 is turned off. In this arrangement, whether the main lifter 61*a* and extension lifter 61*b* are synchronized can be determined based on the sensing result from the extension lifter HP sensor 304.

Since the extension lifter HP sensor 304 is formed in the lower-limit position of the extension lifter 61*b*, the extension lifter 61*b* does not move below the sensing position of the extension lifter HP sensor 304. Accordingly, when the main lifter 61*a* is positioned below the extension lifter 61*b*, the two lifters are not connected, so the extension lifter HP sensor 304 is kept ON. Even when the main lifter 61*a* is at the same height as the lower-limit position of the extension lifter 61*b*, the main lifter 61*a* and extension lifter 61*b* are not completely connected, so the extension lifter HP sensor 304 is ON. In this arrangement, when the extension lifter HP sensor 304 is sensing the extension lifter 61*b* (when the sensor is ON), the main lifter 61*a* and extension lifter 61*b* are not completely connected and there is a step between them, and this makes it possible to determine that elongated paper sheets cannot be stacked. On the other hand, when the extension lifter HP sensor 304 is not sensing the extension lifter 61*b*, both the main lifter 61*a* and extension lifter 61*b* are in a position where they are completely connected, or in a position above this connection completing position. Therefore, the main lifter 61*a* and extension lifter 61*b* are completely connected and there is no step between them, so it is possible to determine that elongated paper sheets can be stacked.

Thus, only the sensing result from the extension lifter HP sensor 304 makes it possible to notify the user of whether the main lifter 61*a* and extension lifter 61*b* are reliably connected, that is, whether elongated paper sheets can be stacked. As an example of this notification, Table 2 shows lighting patterns using the LED 400. In Table 2, "Blinking" indicates that elongated paper sheets cannot be stacked, and "ON" indicates that elongated paper sheets can be stacked.

TABLE 2

| | Plain paper mode | Elongated paper mode |
|---|---|---|
| Extension lifter HP sensor - ON | OFF | Blinking |
| Extension lifter HP sensor - OFF | OFF | ON |

Figure 14:
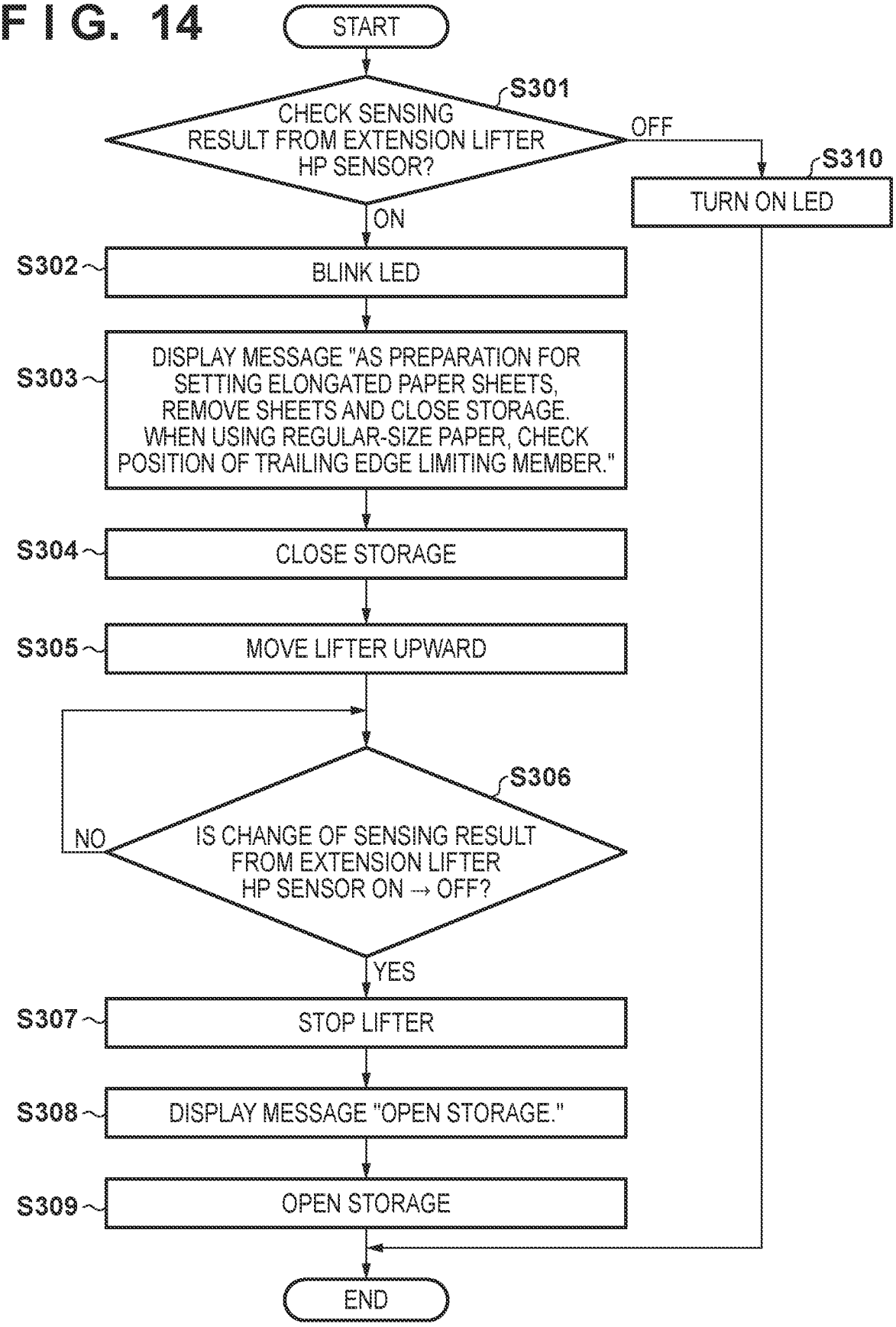
FIG. 14 is a flowchart showing a process of setting elongated paper sheets.

FIG. 14 is a flowchart showing the process of setting elongated paper sheets in the above-described arrangement. Each processing in FIG. 14 is implemented by the CPU of the control unit 41 (to be simply referred to as the CPU hereinafter) by reading out a program stored in the ROM to the RAM and executing the program. The process of FIG. 14 is started when it is detected that the trailing edge limiting member position sensor 302 is ON, that is, the elongated paper mode is set.

In step S301, the CPU checks the sensing result from the extension lifter HP sensor 304. If the extension lifter HP sensor 304 is ON, the main lifter 61*a* and extension lifter 61*b* are not completely connected, and elongated paper sheets cannot be set, as described above. Therefore, the process advances to step S302, and the CPU blinks the LED 400. On the other hand, if the extension lifter HP sensor 304 is OFF, the main lifter 61*a* and extension lifter 61*b* are completely connected, and elongated paper sheets can be set. Therefore, the process advances to step S310, and the CPU turns on the LED 400 (this indicates that elongated paper sheets can be set). After step S310, the CPU accepts setting of elongated paper sheets, and terminates the process of FIG. 14.

In step S303 after step S302, the CPU causes the operation panel 40 to display a message for urging the user to set elongated paper sheets. For example, the CPU displays a message "As preparation for setting elongated paper sheets, remove sheets and close the storage. When using a regular size, check the position of the trailing edge limiting member."

If the CPU detects in step S304 that the storage is closed, the CPU moves the main lifter 61*a* upward in step S305. In step S306, the CPU waits for the extension lifter HP sensor 304 to change in the order of ON→OFF. When the extension lifter HP sensor 304 changes in the order of ON→OFF, the CPU stops the upward movement of the main lifter 61*a* in step S307. After that, in step S308, the CPU causes the operation panel 40 to display a message for urging the user to open the storage. In step S309, the CPU opens the storage, and accepts setting of elongated paper sheets. After that, the CPU terminates the process of FIG. 14.

In this embodiment as described above, the user can identify the state of the lifter 61 in accordance with the lighting patterns of the LED 400. Therefore, when setting elongated paper sheets after having removed plain paper, this eliminates the occurrence of an error by preventing elongated paper sheets from being set with a step being produced. This can eliminate a trouble of error cancellation or the like by the user.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-127813, filed Jun. 29, 2017, and No. 2018-099770, filed May 24, 2018, which are hereby incorporated by reference herein in their entirety.

What is claimed is:

1. A stacking apparatus comprising:

a first stacking unit configured to vertically move between an upper-limit position of upward movement and a lower-limit position of downward movement, and stack a sheet having a first size;

a second stacking unit configured to be coupled with the first stacking unit so that the second stacking unit moves together with the first stacking unit when the position of the first stacking unit is lower than the upper-limit position and higher than a predetermined position in a vertical movement direction of the first stacking unit, the second stacking unit stacking a sheet having a second size larger than the first size by cooperating with the first stacking unit when the second stacking unit is coupled with the first stacking unit, wherein the second stacking unit is decoupled from the first stacking unit when the position of the first stacking unit is even with or lower than the predetermined position and not lower than the lower-limit position;

a first detection unit configured to detect that the first stacking unit is positioned in the predetermined position;

a second detection unit configured to detect that the second stacking unit is positioned in the predetermined position;

an upper surface detection unit configured to detect one of a sheet stacked on the first stacking unit and an upper surface of the first stacking unit;

a setting unit configured to set a size of a sheet to be stacked from sheets having a plurality of sizes including a sheet of the first size and a sheet of the second size; and a determination unit configured to determine that an error has occurred, when the sheet of the second size is set to be stacked by the setting unit, when the upper surface detection unit has detected a sheet stacked on the first stacking unit, and when the first stacking unit is not in the predetermined position and the second stacking unit is in the predetermined position.

2. The apparatus according to claim 1, wherein the error indicates a remaining sheet on the first stacking unit and the determination unit urges a user to remove the remaining sheet.

3. The apparatus according to claim 1, wherein the upper surface detection unit detects one of a sheet stacked on the first stacking unit and the upper surface of the first stacking unit, at a first position higher than the predetermined position and lower than the upper-limit position.

4. A stacking apparatus comprising:

a first stacking unit configured to vertically move between an upper-limit position of upward movement and a lower-limit position of downward movement, and stack a sheet having a first size;

a second stacking unit configured to be coupled with the first stacking unit so that the second stacking unit moves together with the first stacking unit when the position of the first stacking unit is lower than the upper-limit position and higher than a predetermined position in a vertical movement direction of the first stacking unit, the second stacking unit stacking a sheet having a second size larger than the first size by cooperating with the first stacking unit when the second stacking unit is coupled with the first stacking unit, wherein the second stacking unit is decoupled from the first stacking unit when the position of the first stacking unit is even with or lower than the predetermined position and not lower than the lower-limit position;

a first detection unit configured to detect that one of a sheet stacked on the first stacking unit and the first stacking unit is positioned in a first position higher than the predetermined position and lower than the upper-limit position;

a second detection unit configured to detect the second stacking unit in the predetermined position;

a setting unit configured to set a size of a sheet to be stacked from sheets having a plurality of sizes including the sheet of the first size and the sheet of the second size; and a determination unit configured to determine that an error has occurred, when the sheet of the second size is set to be stacked by the setting unit, when the first detection unit has detected a sheet stacked on the first stacking unit before the second detection unit detects the second stacking unit, while the first stacking unit is moving upward.

5. The apparatus according to claim 4, wherein the first detection unit and the second detection unit are configured such that detection by the first detection unit is performed after detection by the second detection unit when no sheet is stacked on the first stacking unit.

6. The apparatus according to claim 4, wherein the first detection unit is configured to detect a sheet on the first stacking unit when the determination unit determines that an error has occurred, and detect the first stacking unit when the determination unit determines that no error has occurred.

7. The apparatus according to claim 4, wherein the error indicates a remaining sheet on the first stacking unit and the determination unit urges a user to remove the remaining sheet.

8. A stacking apparatus comprising:

a first stacking unit configured to vertically move between an upper-limit position of upward movement and a lower-limit position of downward movement, and stack a sheet having a first size;

a second stacking unit configured to be coupled with the first stacking unit so that the second stacking unit moves together with the first stacking unit when the position of the first stacking unit is lower than the upper-limit position and higher than a predetermined position in a vertical movement direction of the first stacking unit, the second stacking unit stacking a sheet having a second size larger than the first size by cooperating with the first stacking unit when the second stacking unit is coupled with the first stacking unit, wherein the second stacking unit is decoupled from the first stacking unit when the position of the first stacking unit is even with or lower than the predetermined position and not lower than the lower-limit position;

a first detection unit configured to detect that the first stacking unit is positioned in the predetermined position;

a second detection unit configured to detect that the second stacking unit is positioned in the predetermined position;

a notification unit configured to notify a user; and a control unit configured to cause the notification unit to perform notification corresponding to a detection result from the first detection unit and a detection result from the second detection unit.

9. The apparatus according to claim 8, wherein the control unit determines based on the detection result from the first detection unit and the detection result from the second detection unit whether the sheet of the second size is stackable, and causes the notification unit to perform notification such that the user can identify a case in which the sheet of the second size is found to be stackable and a case in which the sheet of the second size is found to be unstackable.

10. The apparatus according to claim 8, wherein the notification unit performs notification corresponding to the detection result from the first detection unit and the detection result from the second detection unit by using a plurality of types of optical lighting patterns.

11. The apparatus according to claim 8, further comprising a setting unit configured to set a size of a sheet to be stacked from sheets having a plurality of sizes including the sheet of the first size and the sheet of the second size, wherein the control unit causes the notification unit to perform notification corresponding to the detection result from the first detection unit and the detection result from the second detection unit when a sheet of the second size is set to be stacked by the setting unit.

12. A stacking apparatus comprising:

a first stacking unit configured to vertically move between an upper-limit position of upward movement and a lower-limit position of downward movement, and stack a sheet having a first size;

a second stacking unit configured to be coupled with the first stacking unit so that the second stacking unit moves together with the first stacking unit when the position of the first stacking unit is lower than the upper-limit position and higher than a predetermined position in a vertical movement direction of the first stacking unit, the second stacking unit stacking a sheet having a second size larger than the first size by cooperating with the first stacking unit when the second stacking unit is coupled with the first stacking unit, wherein the second stacking unit is decoupled from the first stacking unit when the position of the first stacking unit is even with or lower than the predetermined position and not lower than the lower-limit position;

a first detection unit configured to detect the first stacking unit;

a second detection unit configured to detect the second stacking unit;

a notification unit configured to notify a user; and a control unit configured to cause the notification unit to perform notification corresponding to a detection result from the first detection unit and a detection result from the second detection unit.

13. The apparatus according to claim 12, wherein the control unit determines based on the detection result from the first detection unit and the detection result from the second detection unit whether the sheet of the second size is stackable, and causes the notification unit to perform notification such that the user can identify a case in which the sheet of the second size is found to be stackable and a case in which the sheet of the second size is found to be unstackable.

14. The apparatus according to claim 12, wherein the notification unit performs notification corresponding to the detection result from the first detection unit and the detection result from the second detection unit by using a plurality of types of optical lighting patterns.

15. The apparatus according to claim 12, further comprising a setting unit configured to set a size of a sheet to be stacked from sheets having a plurality of sizes including the sheet of the first size and the sheet of the second size, wherein the control unit causes the notification unit to perform notification corresponding to the detection result from the first detection unit and the detection result from the second detection unit when a sheet having a size of the second size is set to be stacked by the setting unit.

16. A stacking apparatus comprising:

a first stacking unit configured to vertically move between an upper-limit position of upward movement and a lower-limit position of downward movement, and stack a sheet having a first size;

a second stacking unit configured to be coupled with the first stacking unit so that the second stacking unit moves together with the first stacking unit when the position of the first stacking unit is lower than the upper-limit position and higher than a predetermined position in a vertical movement direction of the first stacking unit, the second stacking unit stacking a sheet having a second size larger than the first size by cooperating with the first stacking unit when the second stacking unit is coupled with the first stacking unit, wherein the second stacking unit is decoupled from the first stacking unit when the position of the first stacking unit is even with or lower than the predetermined position and not lower than the lower-limit position;

a detection unit configured to detect a position of the second stacking unit; and a notification unit configured to perform notification corresponding to a detection result from the detection unit.

17. The apparatus according to claim 16, further comprising a control unit configured to determine, based on the detection result from the detection unit, whether the sheet of the second size is stackable, and causes the notification unit to perform notification such that a user can identify a case in which the sheet of the second size is found to be stackable and a case in which the sheet of the second size is found to be unstackable.

18. The apparatus according to claim 16, wherein the notification unit performs notification corresponding to the detection result from the detection unit by using a plurality of types of optical lighting patterns.

19. The apparatus according to claim 16, further comprising:

a setting unit configured to set a size of a sheet to be stacked from sheets having a plurality of sizes including the sheet of the first size and the sheet of the second size; and a control unit configured to cause the notification unit to perform notification corresponding to the detection result from the detection unit when a sheet of the second size is set to be stacked by the setting unit.

20. The apparatus according to claim 19, wherein, when a sheet of the first size to be stacked is set by the setting unit, the notification by the notification unit is not changed according to the detection result from the detection unit.

21. The apparatus according to claim 16, wherein the detection unit is provided in the stacking apparatus such that the detection unit is able to detect the position of the second stacking unit when the second stacking unit is at the predetermined position.

22. The apparatus according to claim 21, wherein the detection unit detects the position of the second stacking unit when the second stacking unit is decoupled from the first stacking unit.

23. The apparatus according to claim 22, wherein the detection unit does not detect the position of the second stacking unit when the second stacking unit is coupled with the first stacking unit.

24. The apparatus according to claim 23, wherein the detection unit does not detect the position of the second stacking unit when the second stacking unit is coupled with the first stacking unit and the second stacking unit is higher than the predetermined position.

* * * * *